US005523736A

United States Patent [19]

Gosselin et al.

[11] Patent Number: 5,523,736

[45] Date of Patent: Jun. 4, 1996

[54] AUTOMATED BOWLING SCORING SYSTEM

[75] Inventors: Yvan Gosselin, Sillery; Guy Drouin, Quebec, both of Canada

[73] Assignee: Mendes Inc., Ste-Foy, Canada

[21] Appl. No.: 79,015

[22] Filed: Jun. 18, 1993

[51] Int. Cl.[6] ..... G08B 23/00

[52] U.S. Cl. ..... 340/323 B; 364/410; 364/411; 473/54; 473/67; 473/70; 473/71

[58] Field of Search ..... 364/410, 411; 340/323 B; 473/54, 67, 70, 71

[56] References Cited

U.S. PATENT DOCUMENTS 5,126,832 6/1992 Lee et al. ..... 348/29
B1 4,887,813 12/1992 Chiles, III et al. ..... 473/70

FOREIGN PATENT DOCUMENTS 0338768 4/1989 European Pat. Off. ..... 473/70

*Primary Examiner*—Brent A. Swarthout
*Assistant Examiner*—Daryl C. Pope
*Attorney, Agent, or Firm*—McCormick, Paulding & Huber

[57] ABSTRACT

An automated character-based bowling scoring display system provides voltage level encoding of separate red, green, and blue digital signals into a single analog signal for transmission at a standard transmission frequency or a reduced transmission frequency over a single coaxial cable stretching approximately 200 feet to a remote monitor residing in an overhead console. The system provides monitor display of various sizes and fonts of alphanumeric and graphical characters stored in hardware. The reduced transmission frequency results in a wider character when displayed. The system can store up to four additional pages of character information which can be successively and rapidly displayed on a monitor thereby mimicking the animation capability inherent in a more expensive and sophisticated bit-mapped graphics system.

72 Claims, 14 Drawing Sheets

| TYPE OF ANALOG SIGNAL | DIGITAL VALUE B G R | ENCODED INPUT COUPLED TO OUTPUT | ENCODED ANALOG VOLTAGE LEVEL | LOGICAL BITS AT PLA DECODER INPUTS 0-7 |
|---|---|---|---|---|
| HORIZONTAL/ VERTICAL SYNCHRONIZATION | | | 0.0 | 00000000 |
| BLACK | 000 | 0 | 2.0 | 10000000 |
| RED | 001 | 1 | 2.5 | 11000000 |
| GREEN | 010 | 2 | 3.0 | 11100000 |
| YELLOW | 011 | 3 | 3.5 | 11110000 |
| BLUE | 100 | 4 | 4.0 | 11111000 |
| MAGENTA | 101 | 5 | 4.5 | 11111100 |
| CYAN | 110 | 6 | 5.0 | 11111110 |
| WHITE | 111 | 7 | 5.5 | 11111111 |
| CONFIGURATION BITS | | | 6.0 | 11111111 |

FIG. 3

| CONFIGURATION BIT | TRANSMITTED INFORMATION TO REMOTE MONITORS |
|---|---|
| 1 | PASSWORD (VALIDATION) |
| 2 | |
| 3 | |
| 4 | REMOTE MONITOR TV-NTSC CHANNEL SELECT (SELECTS 1 FROM 4) |
| 5 | |
| 6 | REMOTE LEFT MONITOR: TV/SCORE SHEET |
| 7 | REMOTE RIGHT MONITOR: TV/SCORE SHEET |
| 8 | REMOTE LEFT MONITOR: POWER ON/OFF |
| 9 | REMOTE RIGHT MONITOR: POWER ON/OFF |
| 10 | REMOTE CENTER MONITOR: POWER ON/OFF |
| 11 | REMOTE MONITOR VOLUME LEVEL (SELECTS 1 FROM 4) |
| 12 | |
| 13 | PRESENTLY UNUSED |
| 14 | |
| 15 | |
| 16 | |

FIG. 5

| | ADDRESS FOR ACCESSING EACH SCANNED LINE OF CHARACTER IN CHARACTER SET ROM AT A3....A0 | CHARACTER SHAPE INFORMATION STORED AT AN OFF SET ADDRESS A11.....A4 CHAR"∓" | FIRST HALF OF DOUBLE WIDTH "2" | SECOND HALF OF DOUBLE WIDTH "2" |
|---|---|---|---|---|
| 1 | 0000 | 00000000 | 00000000 | 00000000 |
| 2 | 0001 | 00000000 | 00000111 | 11100000 |
| 3 | 0010 | 01111110 | 00001100 | 00110000 |
| 4 | 0011 | 01111110 | 00011000 | 00011000 |
| 5 | 0100 | 01100000 | 00000000 | 00011000 |
| 6 | 0101 | 01100000 | 00000000 | 00110000 |
| 7 | 0110 | 01111100 | 00000000 | 01100000 |
| 8 | 0111 | 01100000 | 00000000 | 11000000 |
| 9 | 1000 | 01100000 | 00000001 | 10000000 |
| 10 | 1001 | 01100000 | 00000011 | 00000000 |
| 11 | 1010 | 01100000 | 00000110 | 00011000 |
| 12 | 1011 | 00000000 | 00001100 | 00011000 |
| 13 | 1100 | 00000000 | 00001111 | 11111000 |
| 14 | 1101 | 00000000 | 00000000 | 00000000 |

FIG. 10

AUTOMATED BOWLING SCORING SYSTEM

BACKGROUND OF THE INVENTION

This invention relates generally to a computerized autoscoring system for a bowling alley and, more particularly, to video generation circuitry of a character-based computer system for handling and transmitting bowler/score information to a console display screen or overhead monitor display screen.

During the past decade, bowling centers have begun to install autoscoring systems comprised of highly sophisticated software and hardware. The computerized systems are practical for electronically keeping track of game information such as players' names or initials, bowling scores, averages, handicaps, the "up" player, etc.

In addition, computerized bowling systems are also capable of providing entertainment through versatile and colorful graphics capability as displayed on a TV-like color screen such as a red, green, blue (RGB) color monitor. For example, some computer systems can display cartoon-like animation for advertising or for simulating a significant bowling achievement such as that of bowling a strike.

Powerful 16/32 bit Central Processing Units (CPUs) are typically used in the most recent bowling systems to provide the above-described functional flexibility and dynamic graphics capability.

A.M.F. discloses in U.S. Pat. No. B1 4,887,813 a computerized automatic bowling scoring system using a Motorola 68000 16-bit microprocessor. Because the large microprocessor used by A.M.F. bas 16 bits, the system is able to employ bit-mapped graphics. In other words, every pixel written on a display screen (CRT) can be changed individually. As a result, sophisticated and realistic outputs can be displayed. However, the high cost of the powerful microprocessor is a significant drawback in employing a bit-mapped method. Another drawback in employing a bit-mapped method is that in order to write text to a monitor, computer software has to copy the bit-mapped character pixel-by-pixel from a reference table in video memory to the display screen which is a time consuming process for a central processing unit (CPU) of a computer system. As can be imagined, a large portion of memory must be dedicated to storing and writing each pixel to an RGB monitor.

In view of the foregoing, it is a general object of the present invention to provide a relatively inexpensive character-based bowling autoscoring system accessing alphanumeric and/or graphical characters in character-by-character fashion using single and double width character sets with a relatively small CPU and which yet substantially duplicates the graphical capability of a much more expensive bit-mapped system.

It is another object of the present to widen the displayed characters by reducing the dot frequency or rate of transmission of alphanumeric and/or graphical character digital information to a monitor.

It is a further object of the present invention to provide multiple character sets each representing the same alphanumeric or graphical characters but in different styles or fonts.

It is yet object of the present invention to provide video memory which can store additional pages of character information while a current page of information is being displayed on a monitor. The additional pages of stored character information permit rapid monitor display switching or animation capability when each of a plurality of additional pages of information is downloaded to the current display memory and display monitor.

It is still another object of the present invention to provide video signal encoding and decoding circuits so as to reduce from a large number to one or two the number of coaxial cables, in the present instance from five to one, running from a floor-based console to a remote overhead console.

SUMMARY OF THE INVENTION

The present invention resides in an automated bowling display system including at least one remote monitor. The system includes means for generating red, green, and blue digital signals suitable for transmission along a coaxial cable to the remote monitor. The system may also includes means for generating horizontal and vertical synchronization digital signals suitable for transmission along a coaxial cable to the remote monitor.

One improvement comprises means for generating a series of voltage level encoded color analog signals. The color analog signals encode the red, green, and blue digital signals so as to be suitable for transmission along a single coaxial cable to the remote monitor.

The another improvement comprises means for reducing the standard transmission rate of the color analog signals to a monitor so as to widen or stretch alphanumeric or graphical characters displayed on a monitor. Preferably, the standard transmission rate is approximately 16 MHz and the reduced transmission rate is approximately 8 MHz.

Preferably the system includes means for generating a voltage level encoded horizontal synchronization analog signal and a voltage level encoded vertical synchronization analog signal for transmission along the single coaxial cable to the remote monitor.

The system may also include means for generating a plurality of voltage level encoded monitor configuration signals to be sequentially transmitted along the single coaxial cable after the color analog signals or the horizontal synchronization analog signal or the vertical synchronization analog signal.

The system also includes means communicating with an analog signal output of the single coaxial cable for decoding the color analog signals back into the original red, green, and blue digital signals.

The system also includes means communicating with an analog signal output of the single coaxial cable for decoding a horizontal synchronization analog signal back into a horizontal synchronization digital signal and for decoding a vertical synchronization analog signal back into a vertical synchronization digital signal.

The system also includes receiving means located near a signal output of the single coaxial cable for electrically separating the plurality of sequentially transmitted monitor configuration analog signals.

Another aspect of the present invention includes character set memory for storing foreground and background character-shape digital information of single and multiple matrix (preferably double width) characters to be displayed on a monitor. The single width characters are defined by a single matrix of digital information of a predetermined size. The multiple matrix (double width) characters are comprised of a plurality (preferably two) matrices of digital information with each matrix of the multiple (two) matrices of digital information defining a part (preferably half) of a character that when displayed together on the monitor form a single character. The character set memory can store a plurality of (preferably four) character sets. Each of the character sets represents alphanumeric and/or graphical characters in a different font.

Yet another aspect of the present invention includes scanned character video memory and scanned attribute video memory for respectively storing a page of alphanumeric and/or graphical character and attribute digital information for immediate display on a monitor by means of a video controller. Also included is a refresh character video memory and a refresh attribute video memory for respectively storing additional pages of alphanumeric and/or graphical character and attribute digital information to be later downloaded in rapid succession to the scanned video memory for display on the monitor so as to mimic animation of a more sophisticated bit-mapped graphics system. The refresh character and attribute video memory are capable of being updated while digital information stored in the character and attribute scanned video memory is displayed.

BRIEF DESCRIPTION OF THE DRAWINGS

FIG. 3 is a table showing the relationship among various digital and voltage level encoded parameters of the analog signal encoding circuit of FIG. 2*a* and the analog signal decoding circuit of FIG. 6.

FIG. 5 is a table showing a proposed functional relationship between sequentially transmitted monitor configuration bits generated by the analog signal encoding circuit of FIG. 2*a* and functions to be performed at a remote monitor.

FIG. 10 illustrates the character shape digital information stored in a character set ROM for the alphanumeric characters illustrated in FIG. 9.

DETAILED DESCRIPTION OF THE PREFERRED EMBODIMENTS

Figure 1:
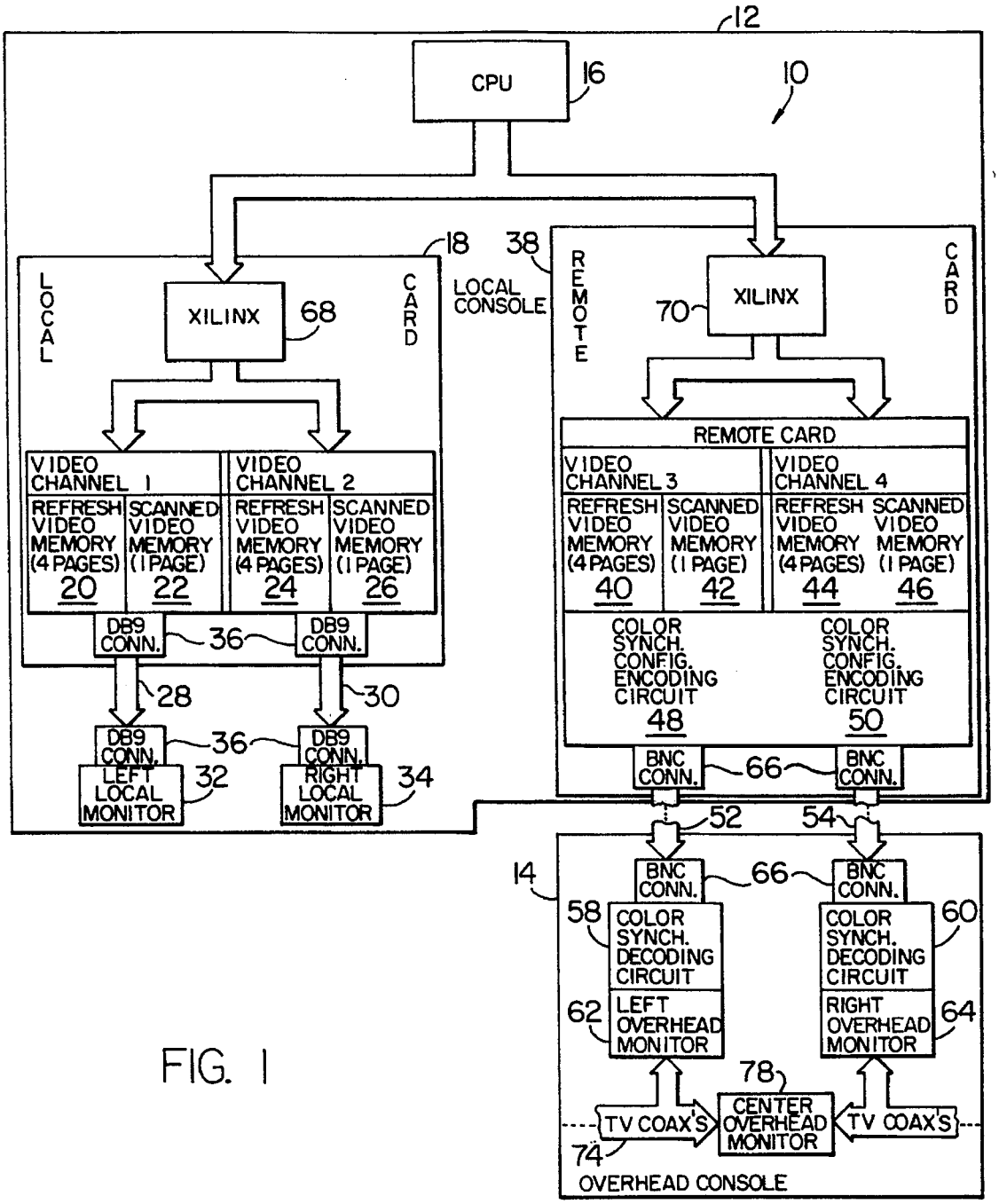
FIG. 1 is a schematic of the automated bowling scorer system of the present invention.

FIG. 1 schematically illustrates automated bowling scorer electronics 10 located in a local, floor-based console 12 and a remote overhead console 14 for generating bowling information for up to four independent video channels from a single CPU 16 located in the local console 12. Each of the four video channels independently controls the bowling information for two adjacent (left and right) bowling lanes.

A local bowling information video card 18 within the local console 12 contains electronics comprising the first two of four video channels. Channel 1 of local card 18 generates video digital signals for the left bowling lane. Within channel 1 of local card 18, four pages of alphanumeric and/or graphical character and attribute video information to be later displayed at a local monitor are stored in refresh video memory 20, and one page of video information to be immediately displayed at a local monitor is stored in scanned video memory 22. Similarly to that of channel 1, channel 2 of local card 18 generates video digital signals for the right bowling lane. Within channel 2 of local card 18, four pages of character and attribute video information to be later displayed at a local monitor are stored in refresh video memory 24, and one page of video information to be immediately displayed is stored in scanned video memory 26. The video channels 1 and 2 transmit video information along corresponding red, green, and blue (RGB) video cables 28 and 30 to respective local left and right monitors 32 and 34 housed in the local or floor-based console 12. Each end of the RGB video cables 28 and 30 employs standard DB9 connectors 36.

A remote video card 38 located in the local console 12 contains electronics comprising the last two of the four video channels. Channel 3 generates video digital signals for the left bowling lane. Within remote channel 3 of remote video card 38, four pages of alphanumeric and/or graphical character and attribute video information to be later displayed at a remote monitor are stored in refresh video memory 40, and one page of video information to be immediately displayed at a remote monitor is stored in scanned video memory 42. Similarly to that of channel 2, channel 4 generates video digital signals for the right bowling lane. Within remote channel 4 of remote video card 38, four pages of video information to be later displayed at a remote monitor are stored in refresh memory 44, and one page of video information to be immediately displayed at a remote monitor is stored in current video memory 46.

The remote channels 3 and 4 within the remote card 38 respectively contain special encoding circuits 48 and 50 for adapting the video information into analog signals so as to be respectively transmitted along coaxial cables 52 and 54 stretching 180 to 200 feet to the remote overhead console 14. Preferably, the coaxial cables are of the type RG-59U. Within the remote overhead console 14 special video signal decoding circuits 58 and 60 respectively retranslate or decode the encoded video analog signals transmitted along coaxial cables 52 and 54 back into the original digital signals. The decoded signals emerging from decoding circuits 58 and 60 inform corresponding remote overhead left and right monitors 62 and 64 within the remote overhead console 14. Each end of the coaxial cables 52 and 54 employs standard BNC connectors 66.

Encoding the digital video information into analog signals for remote transmission allows each remote channel to employ a single coaxial cable as opposed to the high-cost standard practice of employing a multiplicity of coaxial cables per channel.

The CPU 16 controls the four independent video channels via standard auxiliary control or XILINX circuits 68 and 70. XILINX 68 is programmed to generate authorization, transmission frequency, and synchronization signals for communication between the CPU 16 and local video channels 1 and 2. Likewise, XILINX 70 is programmed to generate authorization, transmission frequency, and synchronization signals for communication between the CPU 16 and remote video channels 3 and 4.

As an alternative to bowling information, TV coaxial cables 74 allow the remote overhead left and right monitors 62 and 64 to select from as many as four different NTSC television stations for display.

A remote overhead center monitor 78 is dedicated to the display of a television station by TV coaxial cable 74.

The present invention adapts video information within each remote channel 3 and 4 for transmission along a single coaxial cable which may stretch 180 to 200 feet as mentioned. By contrast, the standard practice of bowling centers for remote information transmission is to employ a multiplicity, typically five, coaxial cables per remote channel. The separate coaxial cables are required to transmit red, green, and blue (RGB) color digital signals, as well as horizontal and vertical synchronization digital signals. Hence, up to one thousand feet of coaxial cable may be needed per lane in a bowling center containing as many as thirty bowling lanes. Since coaxial cable must be used for long distance signal transmission, cabling the overhead monitors can become extremely expensive.

Figure 2A:
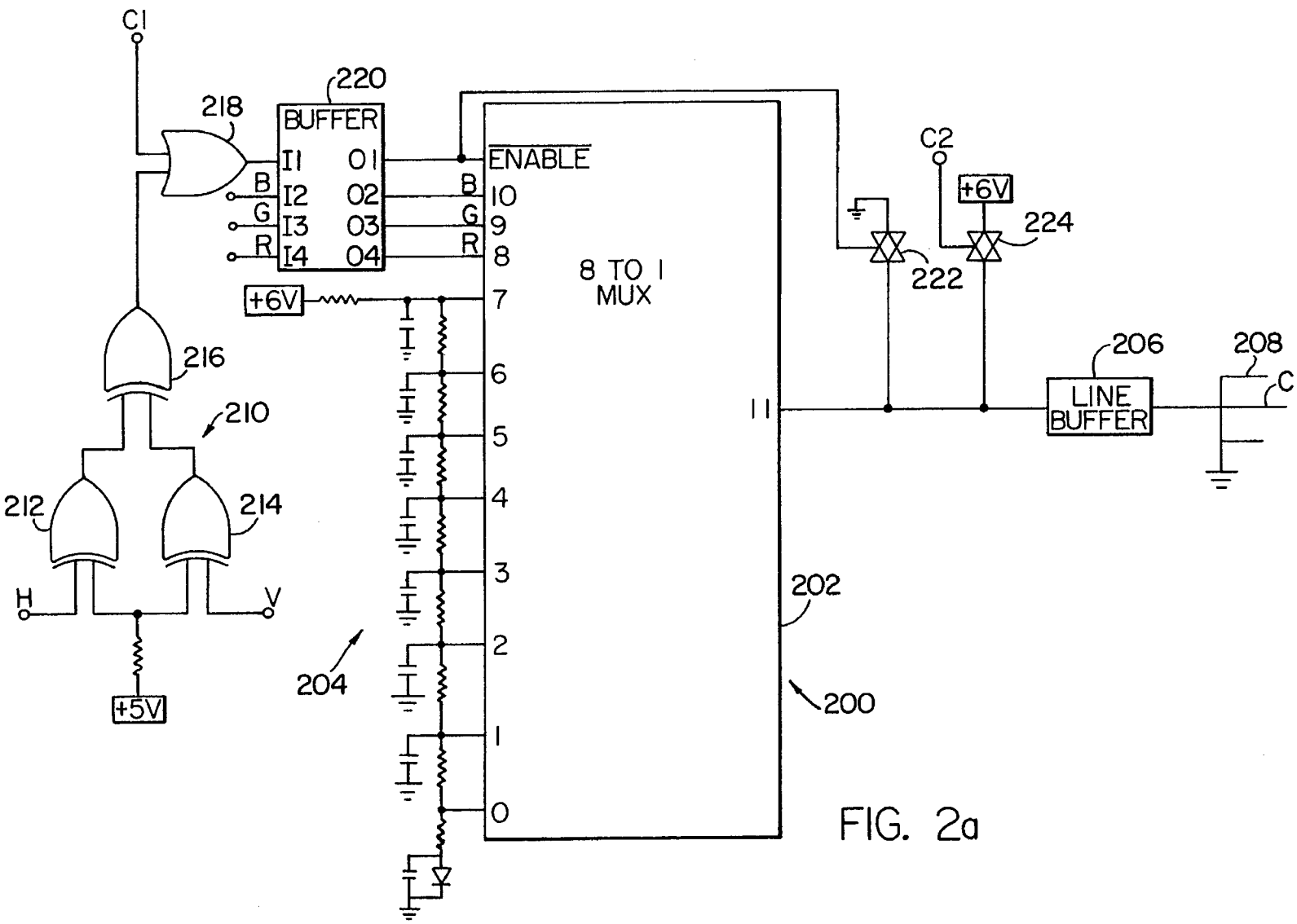
FIG. 2*a* is a schematic diagram of an analog signal encoding circuit in one aspect of the present invention.

Referring now to FIG. 2*a*, a novel video analog signal encoding circuit 200 representative of the remote video channel 3 of FIG. 1 in a floor-based bowling console comprises an 8 to 1 multiplexer (encoder) 202 which encodes separate red, green, and blue (RGB) digital signal pulses into a single voltage encoded analog signal pulse corresponding to a single colored pixel comprising an alphanumeric or graphical character to be illuminated on a remote overhead monitor. The color analog signal is then transmitted at one of two frequencies (to be explained in more detail hereinbelow) at a dot frequency of 16 million cycles per second (16 MHz) or 8 million cycles per second (8 MHz) along a single coaxial cable C stretching typically 180–200 feet to a remote overhead console (not shown). As compared to a dot frequency of 16 MHz, the slower dot frequency of 8 MHz doubles the width of a character to be displayed on a monitor.

For transmitting color information, voltage divider circuit 204 comprising 22 ohm resistors and standard 0.1 microfarad (uF) decoupling capacitors electrically couples each of eight inputs 0 through 7 of the encoder 202 to a different analog voltage level ranging from approximately 2 to 5.5 volts, respectively, at 0.5 volt increments. Each of the eight different analog voltage levels is the encoding information assigned to one of eight different colors to be illuminated as a single pixel on an overhead monitor.

When the encoder 202 is enabled for color analog signal transmission, the RGB digital signals are simultaneously applied to respective select inputs 8,9, and 10 thereof so as to electrically couple one of the eight different analog voltage levels present at inputs 0 through 7 of the encoder 202 to the output at 11 for transmission along the coaxial cable C.

Hence, the RGB digital signal pulses applied to the encoder 202 determine which of eight different colors is to be displayed as a single pixel on a remote overhead monitor. The voltage encoded RGB analog signal present at the output 11 of the encoder 202 is then sent through a standard line buffer 206 and transmitted along 180 to 200 feet of a single coaxial cable C to a remote overhead console. A standard BNC connector 208 electrically couples the output of line buffer 206 with a analog signal entrance end of the coaxial cable C.

The encoder 202 is enabled or disabled for color analog signal transmission via digital logic circuit 210 comprising exclusive OR gates 212,214,216 and OR gate 218. Each exclusive OR gate 212 and 214 has an input fixed to a high digital voltage level (+5 Volts) via a 4.7 kilo-ohm resister. The other input of exclusive OR gate 212 is electrically coupled to a horizontal synchronization control digital signal source. The other input of exclusive OR gate 214 is coupled to a vertical synchronization control digital signal source. The digital signals generated at outputs from exclusive OR gates 212 and 214 form the inputs of exclusive OR gate 216. The digital signal generated at output of exclusive OR gate 216 forms one input of an OR gate 218. The other input of OR gate 218 is fed by a configuration control digital signal C1 originating from standard auxiliary control circuitry such as a XILINX circuit. The digital signal generated at output of OR gate 218 low enables the encoder 20 at ENABLE via buffer 220 when either a horizontal synchronization digital signal H, a vertical synchronization digital signal V, or a monitor configuration control digital signal C1 (to be explained hereinbelow) is present.

When either a horizontal or vertical synchronization control source is high for synchronization signal transmission, the encoder 202 is disabled so as to prevent color signal transmission and bidirectional switch 222 having one terminal connected to ground is closed so as to generate and voltage level encode a horizontal or vertical synchronization analog signal at zero volts for transmission. The synchronization analog signals are set at either a low or high voltage level relative to the voltage level range of the color analog signals so as to distinguish one type of signal from the other. The synchronization analog signal is then sent through the line buffer 206 and transmitted along the coaxial cable C to a remote monitor (not shown).

FIG. 3 is a reference table illustrating, in this instance, the correspondence between the type of analog signal, the color digital signal values, the corresponding encoder 202 input coupled to the output, the encoded analog voltage level, and decoding programmable logic array (PLA) digital information to be discussed later. As can be seen from FIG. 3, eight different colors to be illuminated as a single pixel can be generated from the video generating circuit 200 of FIG. 2*a*. Of course, the coupled encoder input, voltage encoded video signal value, and decoding information are arbitrarily set and are changeable.

Figure 4A:
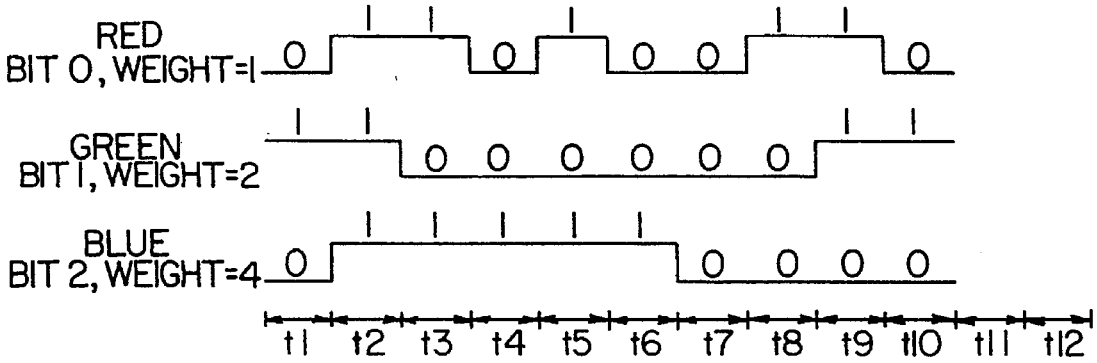
FIG. 4*a* is a timing diagram showing a random sequence of red, green, and blue (RGB) digital signals.
Figure 4B:
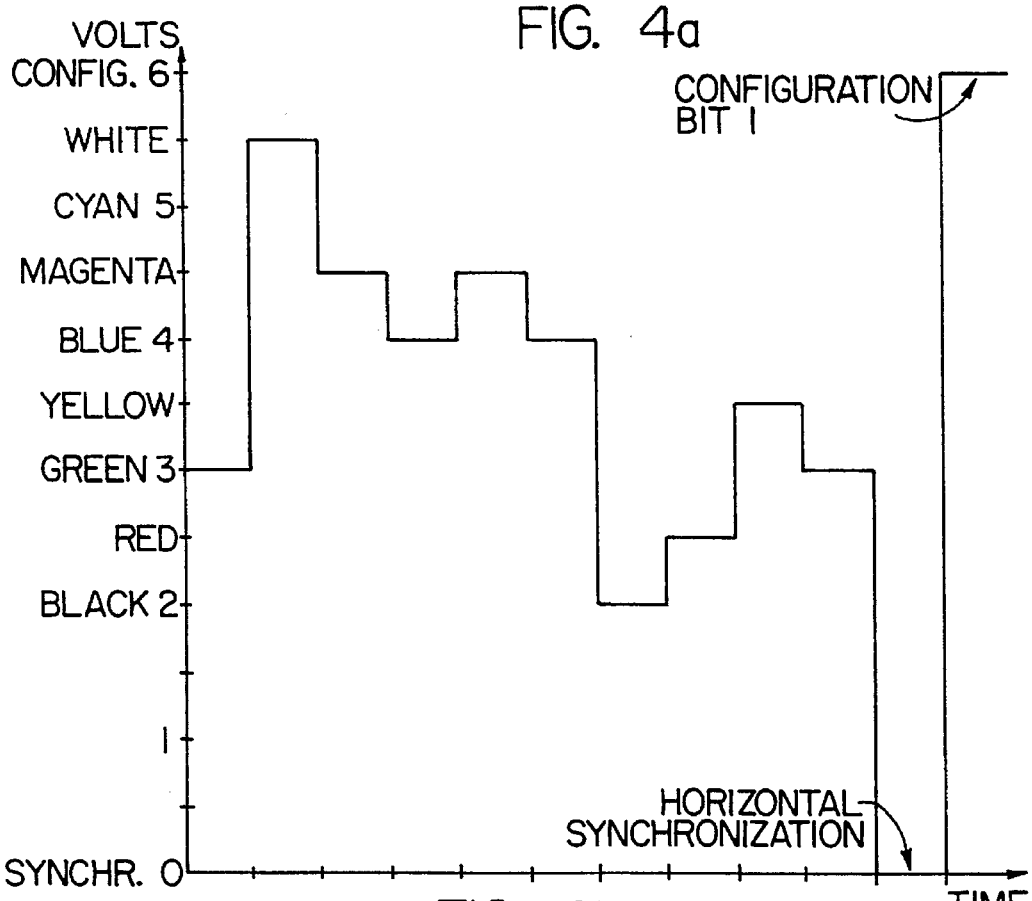
FIG. 4*b* is a timing diagram showing a single voltage level encoded color analog signal encoding the three separate RGB digital signals of FIG. 4*a* as generated by an analog signal encoding circuit.

The operation of the video signal encoding circuit 200 of FIG. 2*a* can be more easily understood with reference to the table of FIG. 3 and the RGB digital signals and voltage level encoded analog signal timing diagrams of FIGS. 4*a* and 4*b* respectively.

Referring to FIG. 4*a*, during a first time interval t1, a first set of RGB digital signals seen at the far left has a digital value of B="0", G="1", and R="0", where "0" and "1" are the two possible states or values of a "bit", the smallest unit of digital information. A bit="0" means that a digital signal is zero (0) volts or "low". A bit="1" means that a digital signal is five (+5) volts or "high". The respective BGR digital values of "010" is the standard digital information for illuminating a single green pixel on a monitor. At time t1, the output of the encoder 202 of FIG. 2*a* at 11 is electrically coupled to the input 2 thereof at a potential of 3 volts by means of the voltage divider circuit 204 (see FIG. 3). Hence, a single voltage level encoded analog signal for displaying a green pixel—shown at the same time interval t1 in FIG. 4*b*—is transmitted along 180 to 200 feet of coaxial cable C to a remote monitor.

During a second time interval t2, a second set of RGB digital signals seen immediately to the right of the first signal of FIG. 4*a* has a digital value of: B="1", G="1", and R="1". These are the standard BGR digital values assigned for a single white pixel to be displayed. At time t2, the output of the encoder 202 of FIG. 2*a* at 11 is electrically coupled to the input 7 thereof at a potential of 5.5 volts by means of the voltage divider circuit 204 (see FIG. 3). Hence, a single voltage level encoded analog signal for displaying a white pixel—shown at the same time interval t2 in FIG. 4*b*—is transmitted along the coaxial cable C.

As seen in the RGB digital signal and voltage level encoded analog signal timing diagrams of FIGS. 4*a* and 4*b*, during subsequent time intervals t3 through t10, sets of analog signals for displaying pixel colors: magenta (t3), blue (t4), magenta (t5), blue (t6), black (t7), red (t8), yellow (t9) and green (t10) are sequentially or serially transmitted along the coaxial cable C in a manner similar to that of the first two color analog signals.

As is standard in color signal transmission, after a scanned line of information has been written from left to right on a display screen, a horizontal synchronization digital signal is then transmitted along a separate coaxial cable. With the video generating circuit 200 of FIG. 2*a*, however, a voltage level encoded horizontal synchronization analog signal can be transmitted along the single coaxial cable C (shown at time interval t11 in FIG. 4*b*) to a remote RGB monitor. The horizontal synchronization analog signal is transmitted at a standard frequency of 15,750 cycles per second (15.750 KHz) and is arbitrarily predetermined, in this instance, to be transmitted at zero volts so as to be distinguished from the voltage level of that of the color analog signal (see FIG. 3).

As is also standard, after a frame or page of scanned information has been transmitted to a monitor, a vertical synchronization digital signal is transmitted along a separate coaxial cable. With the present invention, however, a voltage level encoded vertical synchronization analog signal is transmitted (not shown in FIG. 4*b*) along the single coaxial cable C at a standard frequency of 60 cycles per second (60 Hz). The vertical synchronization analog signal is arbitrarily set at a predetermined value of zero volts (see FIG. 3) so as to be distinguished from color analog signals and is of a longer duration than that of the horizontal synchronization analog signal for the purpose of distinguishing one type of synchronization signal from the other.

An additional novel feature of the present invention is that the standard color signal transmission frequency of 16 MHz established by conventional auxiliary processing circuitry such as a XILINX circuit (see FIG. 1) allows up to 16 additional bits of voltage level encoded analog information to be sequentially transmitted. These monitor configuration analog signals are for controlling various features such as the power, volume, and display of several, in this instance three, remote monitors. In this instance, the configuration bits are sequentially transmitted following a horizontal synchronization analog signal but may be transmitted after a series of color analog signals or a vertical synchronization analog signal. The last signal shown in FIG. 4*b* at time interval t12 is the first of a series of such configuration analog signals that transmit information which is either high (positive) or low (negative). The configuration signals (whose function will be explained shortly) are arbitrarily set at 6 volts when transmitting positive information and approximately zero volts when sending negative information. The voltage level and timing of the configuration pulses after the horizontal synchronization pulse is what distinguishes the series of configuration signals from color and synchronization signals.

Configuration signals are especially useful for remotely controlling a plurality of remote monitors from, for instance, a control desk or station for the entire bowling center. To understand what configuration signals can control, it will be helpful to first explain some features of a typical bowling autoscoring system.

As mentioned previously, a local floor-based console having left and right monitors and a remote overhead console having left and right monitors are associated with two adjacent bowling lanes. A single CPU located in the local floor-based console can typically govern up to four independent video channels—one for each floor-based and overhead monitor.

In addition, television (TV) broadcast stations are typically transmitted to the remote overhead consoles. Additional central monitors dedicated solely to TV transmission are often employed with overhead consoles. Typically, one to four different television channels may be selected for display from the front desk of the bowling center. Additional coaxial cabling is usually dedicated for transmitting television signals for TV channel display capability.

FIG. 5 is a table outlining a possible implementation of the novel, in this instance 16, voltage level encoded configuration bits which may be transmitted after a horizontal synchronization signal to a remote overhead console comprising left, center, and right monitors. The first three sequentially transmitted bits of FIG. 5 (bits 1,2,3) have been arbitrarily chosen to transmit a password or validation to be matched with standard CPU board identification circuitry (not shown). If the password is correct, the CPU can inform the video generating circuit using standard control signals that the following train of configuration bits is correct. Bits 4 and 5 are TV-NTSC channel select signals for choosing one from a possible four different television stations. Bit 6 switches the left overhead monitor between a scoresheet mode and a TV mode. Bit 7 switches the right overhead monitor between a scoresheet mode and a TV mode. Bit 8 controls power on/off for the left overhead monitor. Bit 9 controls power on/off for the right overhead monitor. Bit 10 controls power on/off for the center overhead monitor. Bits 11 and 12 select from one of four different volume levels for all of the overhead monitors. Bits 13 through 16, in this instance, are not used. The unused bits, of course, may be given a function if so desired. The configuration bits need not be limited to the order of assignment above. The bits may be assigned to control the above features in any practical order. In addition, other control features may be assigned to the configuration bits if so desired.

The generation and voltage level encoding of the series of configuration analog signals for sequential transmission along a single coaxial cable C can be understood with reference to FIG. 2*a*. During configuration signal transmission, a high level configuration control digital signal C1 is ORed through OR gate 218 so as to disable encoder 202 used for color signal transmission. A sequence of configuration control digital signals or bits of information C2 either opens or closes bidirectional switch 224 connected at one end to a +6 volt source and connected to one end of the line buffer 206 at the other end. If C2 goes high, bidirectional switch 224 closes so as to voltage level encode and generate a monitor configuration analog signal carrying a positive bit of information (+6 Volts) for transmission through line buffer 206 and along the coaxial cable C, otherwise if C2 goes low, switch 224 opens so as to voltage level encode and generate a monitor configuration analog signal carrying a negative bit of information (0 Volts) for transmission through line buffer 206 and along the coaxial cable C.

Because the sequentially transmitted monitor configuration bits of analog information control several, in this instance three remote monitors as shown in FIG. 1, only one of the two remote video channels shown in FIG. 1 need be adapted to transmit the configuration bits. FIG. 2*a* shows one of the two remote video channels, for instance channel 3 of FIG. 1, adapted to transmit the monitor configuration information.

Figure 2B:
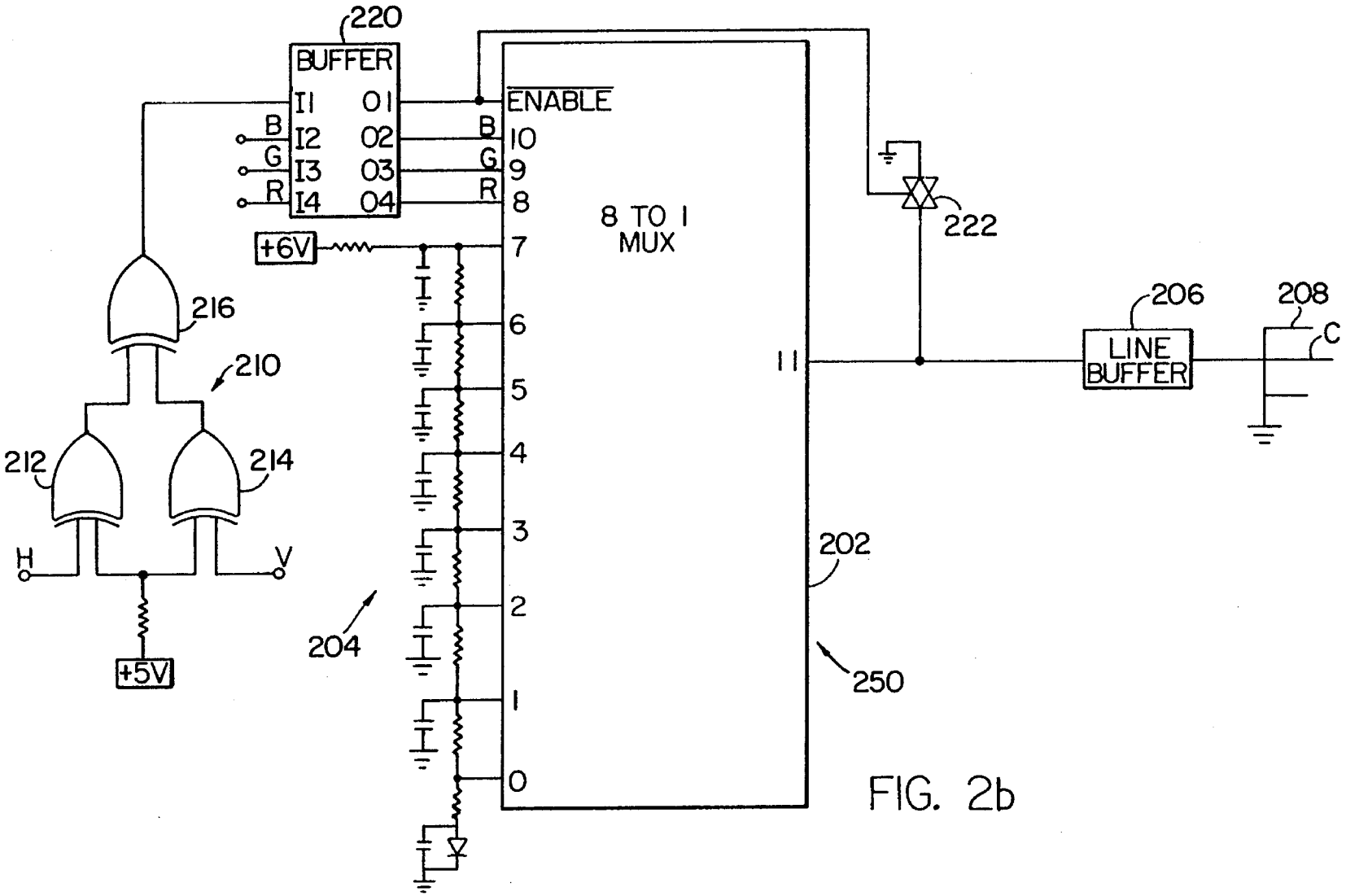
FIG. 2*b* is a schematic diagram of another embodiment of an analog signal encoding circuit.

FIG. 2*b* schematically illustrates a video analog signal encoding circuit 250, such as remote channel 4 of FIG. 1, that does not transmit monitor configuration digital information. Like components with those of the encoding circuit 200 shown in FIG. 2*a* are labeled with like numerals. Because the encoding circuit 250 does not transmit configuration information, the configuration switch 224 and configuration control signals C2 shown in FIG. 2*a* are not necessary in the encoding circuit of FIG. 2*b*. For the same reason, the OR gate 218 and configuration control signal C1 also shown in FIG. 2*a* are not necessary in the encoding circuit 250 of FIG. 2*b*.

No configuration information is sent to the local monitors. Since the local monitors, in this instance, do not receive television stations, no volume control and display switching control between a bowling display format and a TV station are necessary. In addition, no power on/off control is necessary since local monitors are usually kept on continuously by sending black color signals to be displayed during "down time".

Figure 6:
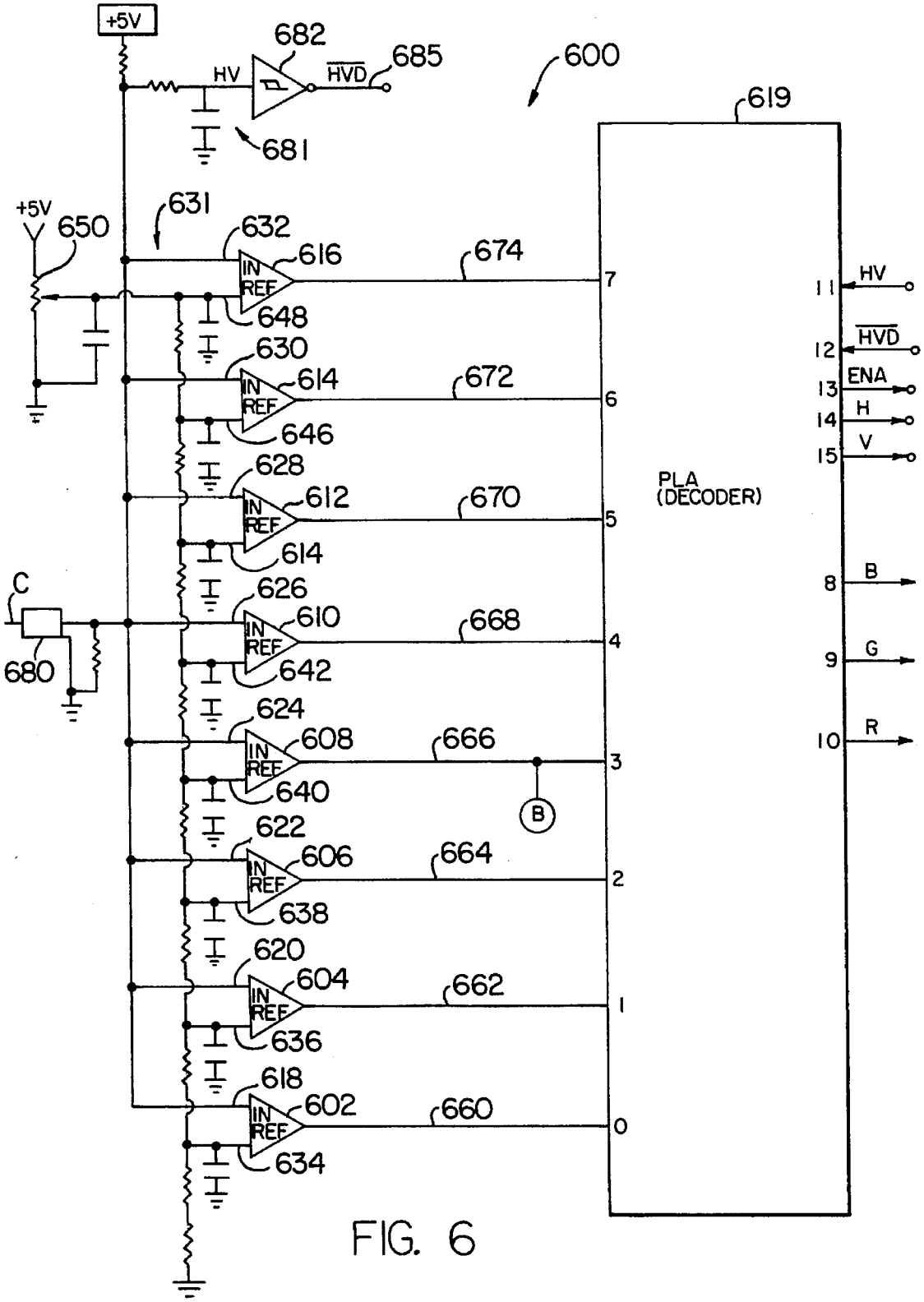
FIG. 6 is schematic of an RGB decoding circuit for reconstituting the coaxially transmitted voltage encoded RGB signal back into the original RGB digital signals.

Referring now to FIG. 6 a decoding circuit 600 for a single remote video channel is provided at the signal exit end of the coaxial cable C in a remote overhead bowling console in order to convert the encoded analog signals back into the original digital signals so as to be compatible with electronic circuitry and standard monitors. The decoding circuit 600 communicates with the analog signal exit end of the coaxial cable C.

With regard to the series of coaxially transmitted color analog signals, the decoding circuit decodes the color analog signals originating from the video signal encoding circuit 200 of FIG. 2*a* back into the original RGB digital signals so as to be compatible with standard DB9 connectors employed with RGB monitors.

A series of eight voltage comparators 602 through 616 generate intermediate digital signals for decoding a single color analog signal back into the three original RGB digital signals. Respective IN inputs 618 through 632 of the eight comparators 602 through 616 are electrically coupled to the signal exit end of the coaxial cable C via a standard BNC connector 680 which interfaces the coaxial cable to the decoding circuit 600. Respective REF (reference) inputs 634 through 648 of the comparators 602 through 616 are electrically coupled to a different voltage level along the voltage divider circuit 630 comprised of 47 ohm resistors.

When the voltage level of a color analog signal received from the coaxial cable C at an IN input of a comparator is above the voltage level at a REF input of a comparator, the comparator is active and generates a high digital signal (digital voltage level="1") at its output, otherwise the comparator is inactive and generates a low digital signal (digital voltage level="0") at its output. Each REF input is also connected via a 0.1 micro-farad (uF) decoupling capacitor to ground in order to protect the comparator from static charge build-up.

A voltage divider 630 communicating with the REF inputs 632 through 648 of the comparators 602 through 616 is calibrated by a trim pot 650 so that all of the comparators 660 through 674 is inactive (generates a low voltage level digital signal="0" at 0 volts) at respective outputs 660 through 674 when either a horizontal or vertical synchronization analog signal (encoded at zero volts as in FIG. 3) is present at respective IN inputs 618 through 632.

Taking into account voltage level attenuation of a transmitted signal along approximately 180 to 200 feet of coaxial cable, the voltage divider 630 is also calibrated so that only comparator 602 is active or generates a high digital signal on output 660 when an analog color signal representing the color black (encoded at 2.0 volts as in FIG. 3) is present.

In addition, only comparators 602 and 604 are active or generate a high digital signal on respective outputs 660 and 662 when an analog color signal representing the color red (encoded at 2.5 volts as in FIG. 3) is present.

Following the previous pattern, only comparators 602, 604, and 606 are activate or generate a high digital signal on respective outputs 660,662, and 664 when an analog color signal representing the color green (encoded at 3.0 volts as in FIG. 3) is present, etc. until all eight comparators 602 through 616 are activated when an analog color signal representing the color white (encoded at 5.5 volts) is present.

The intermediate digital information generated from corresponding outputs 660 through 674 of comparators 602 through 616 are supply respective inputs 0 through 7 of a standard programmable logic array (PLA) 619 which uses the intermediate digital information from the comparators to decode the transmitted single analog color signal back into the three original red, green, and blue (RGB) digital signals. The RGB digital signals are generated at corresponding outputs 8,9, and 10 of the PLA 619. The sequence of high and low level intermediate digital signals received at inputs 0 through 7 of PLA 619 (see FIG. 3, rightmost column) is the decoding information for generating the RGB output digital signals.

Referring back to the table of FIG. 3, the rightmost entry shows from left to right the different combinations of digital information that may be present at PLA inputs 0 through 7 originating from the respective outputs 660 through 674 of comparators 602 through 616. As explained previously, each of the eight different colors to be illuminated on a monitor as a single pixel is represented by a different combination of active and inactive comparators and, therefore, the combination of high and low bits of information present at inputs 0 through 7 of the PLA 619.

Inverter circuit 681 is an RC circuit for distinguishing between a horizontal or a vertical synchronization analog signal. Circuit 681 is electrically coupled with the transmission end of the coaxial cable C by means of a 4.7K ohm resistor and a 20K ohm resistor. The other end of the 4.7K ohm resistor is connected to a +5 volt power source. The other end of the 20K ohm resistor is connected to an input of a Schmitt Trigger inverter 682 and an end of a 3.3 uF capacitor. The other end of the capacitor is grounded.

A unique method for distinguishing between the two synchronization signals will now be explained. When a horizontal synchronization signal is transmitted along the cable C, the signal is typically on (low) ten percent of its duty cycle and off (high) ninety percent of its duty cycle. When a vertical synchronization signal having a relatively longer duty cycle is to be transmitted, the logic circuit 210 of FIG. 2*a* at the transmitting end of the cable C inverts one or more duty cycles of the horizontal synchronization signal. Hence, a novel feature of the present invention employs the vertical synchronization analog signal as the inverse of the duty cycles of the horizontal signal or, in other words, the vertical analog signal is on (low) approximately ninety percent of its duty cycle and off (high) approximately ten percent of its duty cycle.

The inverter circuit 681 of FIG. 6 is calibrated by the resistors and capacitor so as to have a sufficiently long RC time constant so that a relatively short-lived horizontal signal does not change the value of the digital signal generated at the output 685 thereof carrying digital signal HVD. On the other hand, the relatively long-lived vertical signal is on long enough to change the value of the digital signal generated at the output 685 thereof. In other words, because a horizontal signal is active (low) only 10 percent of its duty cycle, the capacitor 684 does not have time to fully discharge to make the input of inverter 682 go low and thereby trigger Schmitt Trigger inverter 682 to switch its inverted output from low to high. Hence, the inverter outputs a low signal (HVD) for a horizontal signal.

A vertical signal, on the other hand, is on (low) ninety percent of a relatively longer duty cycle which is long enough to discharge capacitor 684 thereby bringing the input of inverter 682 low enough to trigger the inverter 682 to output a high HVD signal. The digital signal HVD at output 685 of the inverter circuit 681 is coupled to input 12 of PLA 619 so as to generate either a horizontal synchronization digital signal at 14 or a vertical synchronization digital signal at 15.

If the decoding circuit 600 is a remote channel receiving configuration information, such as channel 3 of FIG. 1, then following the generation of a horizontal synchronization digital signal from PLA 619 at output 14 thereof, PLA 620 generates a configuration bit receiving enabling signal ENA at output 13 thereof so as to activate a configuration bit receiving circuit (to be discussed shortly) to receive up to 16 bits of additional monitor configuration information. If the decoding circuit 600 is a remote channel not receiving configuration information, such as channel 4 of FIG. 1, then the ENA output 13 of PLA 619 is disabled from other circuitry.

Figure 7:
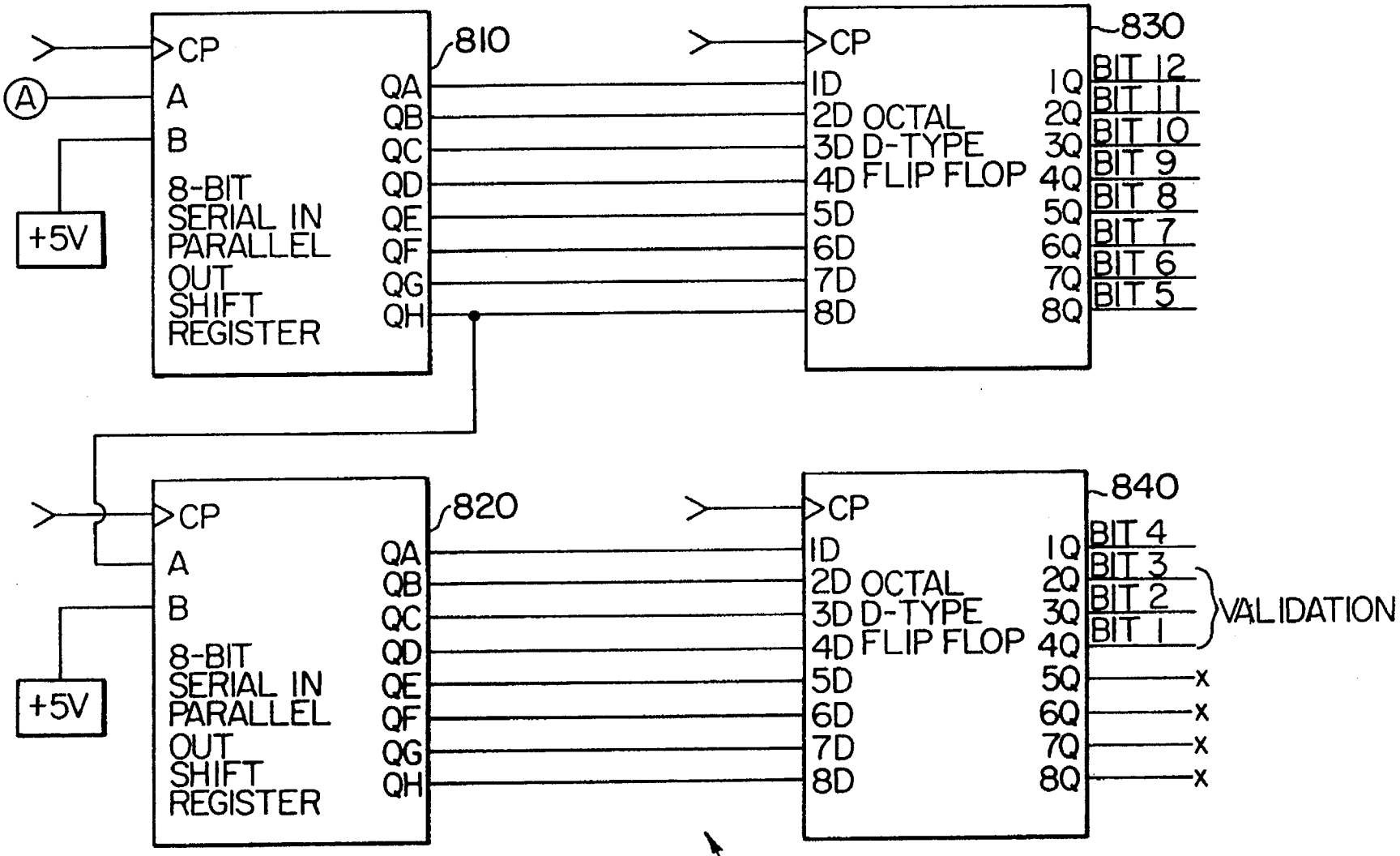
FIG. 7 is a schematic of a monitor configuration bit receiving circuit in another aspect of the present invention.

Referring now to FIG. 7, a configuration bit receiving circuit 800 located within one of the two remote channels such as channel 3 of FIG. 1 in a remote overhead console, latches and separates up to 16 (in this instance 12) sequentially transmitted configuration bits of analog information as described in FIG. 5.

Two 8-bit serial in/parallel out shift registers 810 and 820 allow up to 16 configuration bits available for controlling left, right and center remote overhead monitors.

Shift registers 810 and 820 each have a clock pulse (CP) input coupled with the frequency (16 MHz) of transmission of the monitor configuration bits. The clock pulse to the decoding circuitry is enabled from the output ENA of PLA 619 as explained previously with reference to FIG. 6. Shift register 810 sequentially receives the clocked configuration bits first. Shift register 820 subsequently receives the overflow of the configuration bits shifting along the outputs QA through QH of shift register 810. Each shift register has two data inputs A and B, one of which must be high in order to enable the other input. Inputs B of shift registers 810 and 820 are arbitrarily chosen to be permanently set high, thereby enabling inputs A of both shift registers to receive the configuration bit data.

The configuration input A of shift register 810 is not coupled directly to the coaxial line because the shift registers must receive a digital signal (i.e. 0 or +5 volts), whereas the voltage level of the configuration analog signal transmitted along approximately 200 feet of coaxial cable has attenuated significantly to about 3 volts.

The digital signal output by comparator 608 of the decoding circuit 600 shown in FIG. 6 has been arbitrarily chosen to digitize a high or low configuration analog signal is high or low and is, therefore, electrically coupled to the input A of shift register 810. The reason comparator 608 has been chosen to digitize the configuration signal information is because the comparator is calibrated to generate a high digital signal for an incoming analog signal with a voltage level greater than a level approximately midway between a low and high analog signal. Hence, the comparator 608 generates a low digital signal of "0" if the incoming analog signal is low or falls below the midpoint reference level, otherwise the comparator 608 generates a high digital signal of "1" if the incoming analog signal is high (approximately +3 volts after coaxial transmission attenuation) or is above the midpoint reference level.

Turning now to the operation of the configuration receiving circuit 800 of FIG. 7, during a first clock pulse, monitor configuration bit 1 (see FIG. 5) is received at input A of shift register 810 and is coupled to output QA. During a second clock pulse, configuration bit one is shifted to output QB and configuration bit two is received at input A and is coupled to output QA. During succeeding clock pulses the subsequent bits are sequentially received at input A of shift register 810 and serially shifted along outputs QA through QH so that after the eighth clock pulse, bits 1 through 8 are present at respective outputs QH through QA of shift register 810. During the ninth clock pulse, configuration bit 1 present on QH of shift register 810 is then shifted by an overflow line from output QH of shift register 810 to input A of overflow shift register 820 so as to be coupled to output QA of overflow shift register 820. Hence at the end of 12 clock pulses, 12 of up to 16 possible configuration bits of information (see FIG. 5) are present in parallel at the eight outputs QA through QH of shift register 810 and the four outputs QA through QD of overflow shift register 820. The configuration bits present on shift registers 810 and 820 are then latched to appropriate circuitry such as respective D-type flip flops 830 and 840 whose outputs are directed to standard circuitry to control address validation. TV-NTSC channel select, TV vs. score sheet display, monitor power on/off, and volume level control.

Figure 8A:
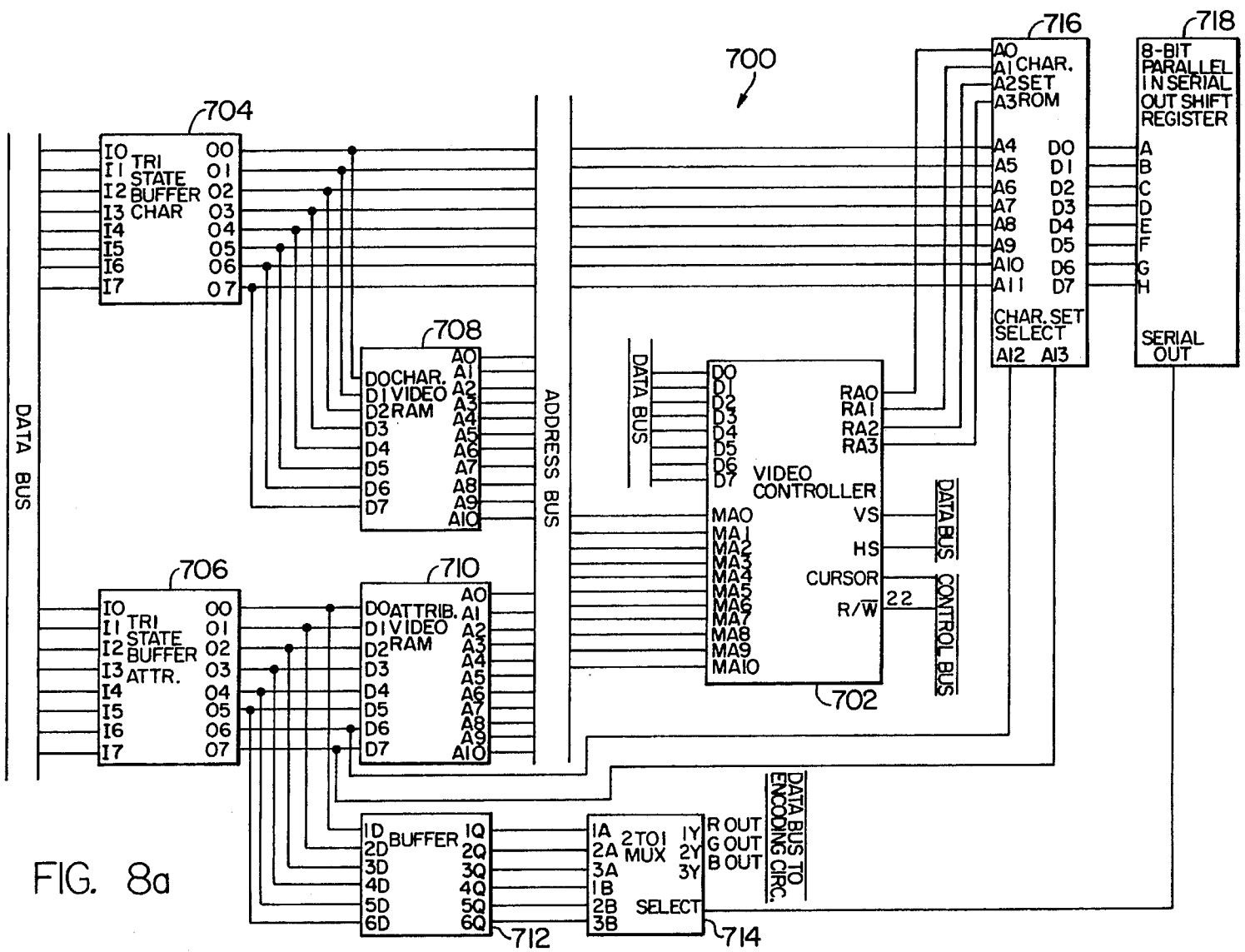
FIG. 8*a* is a schematic of a video generating circuit in another aspect of the present invention.

FIG. 8*a* schematically illustrates a unique video generating circuit 700 of the present invention for generating RGB digital signals within either a local or a remote video channel. The video generating circuit 700 is employed with a CPU (not shown) employing a standard and relatively inexpensive Motorola 6809 8-bit microprocessor 702. Because a relatively inexpensive 8-bit microprocessor is employed, the video generating circuit 700 cannot perform bit-mapped graphics. Instead, the CPU and the video generating circuit 700 must utilize a hardware character-based display method. In other words, character information previously stored in a character set ROM 716 is written one character at a time to a display screen. A tradeoff with using a character-based method is of course that of reduced versatility since only previously stored characters sets can be displayed. However, the relatively low cost of an 8-bit microprocessor coupled with novel multiple (double) width characters and page switching hardware (to be explained later) allow the autoscoring system of the present invention to successfully simulate the performance of a much more expensive bit-mapped graphics system.

The video generating circuit 700 of FIG. 8*a* generates red, green, and blue (RGB) digital signals for illuminating a pixel on a color display screen or RGB monitor in one of eight different colors. As is known, a pixel on a color display screen is comprised of an illuminated combination of three different types of closely spaced phosphor dots in three different primary colors (red, green, and blue). The combination of three different color phosphor dots are closely spaced so as to be perceived as a single color pixel when illuminated. The perceived color of a pixel is a function of the combination and intensity of red, green, and blue dots that are illuminated in response to the RGB digital signals.

Figure 9C:
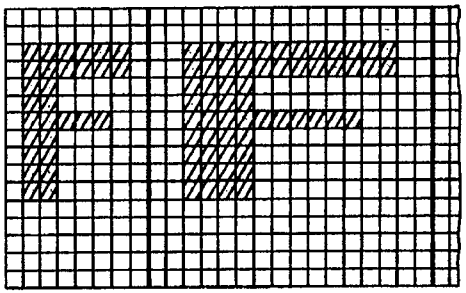
FIG. 9*c* schematically shows a small substantially enlarged portion of a monitor display illustrating two single width characters transmitted thereto at different dot frequencies in accordance with the present invention.
Figure 9D:
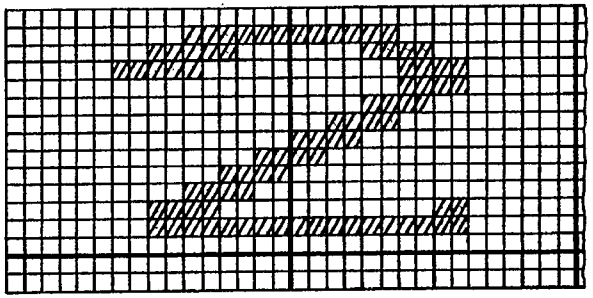
FIG. 9*d* schematically shows a small substantially enlarged portion of a monitor display illustrating a double width character transmitted thereto at a reduced dot frequency.
Figure 9A:
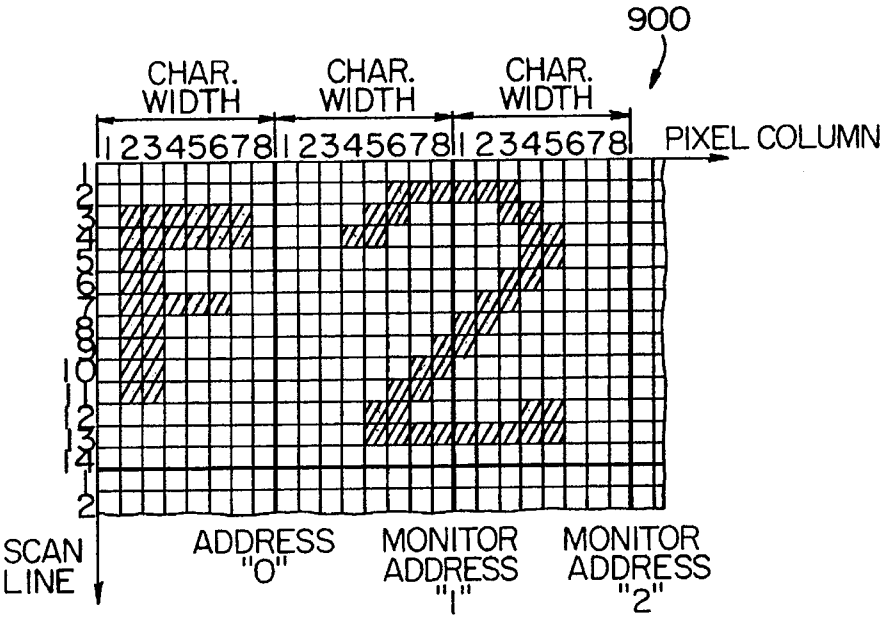
FIG. 9*a* schematically shows a small substantially enlarged portion of a monitor display illustrating different character widths in accordance with the present invention.

FIG. 9*a* shows the upper leftmost portion of a color display screen or RGB monitor 900 displaying—in this instance—alphanumeric characters "F" and "2" produced by the video generating circuit 700 of FIG. 8*a*. The character "F" is a single width character formed from a standard 14 column by 8 row (line) character matrix of pixels. The character "2" is a special multiple (double) width character formed from multiple (two) adjacent matrices of pixels. Each of the 14 lines or rows defining the shape of a character such as "F" comprise 8 pixels illuminated on a monitor in either a foreground color (seen as darkened grids in FIG. 9*a*) or a background color different from that of the foreground color (seen as light-colored grids in FIG. 9*a*) during a horizontally left to right scanning process.

In FIG. 9*a*, only a small substantially enlarged section of monitor 900 is shown. Typical displays such as monitor 900 can, in fact, display 96 single width characters across the entire display screen. The foreground and background colors may vary from character to character. The totality of information which may be contained on a monitor screen at a given time is hereinafter defined as a "page" of information.

The shape of an alphanumeric or graphical character to be displayed on a monitor is stored as bits of digital information in a character set ROM 716 shown in FIG. 8*a*. Each "character shape" bit stored in the ROM 716 is mapped to a single pixel to be displayed on a monitor comprising the 14 line by 8 column character matrix defining the shape of the character.

The character shape digital information stored in the character set ROM 716 for the single width character "F" and the double width character "2" is illustrated in the second column of FIG. 10. Each of the 14 lines of information defining the single width character "F" is stored in successive memory addresses in the character set ROM 716. Each address contains a string of 8 character shape bits. Each of the 8 bits determines whether a corresponding pixel on a monitor is to be illuminated in either an assigned foreground color or an assigned background color. If a character shape bit has a digital value="1" a foreground color is selected. If a character shape bit has a digital value="0" a background color is selected.

Figure 9B:
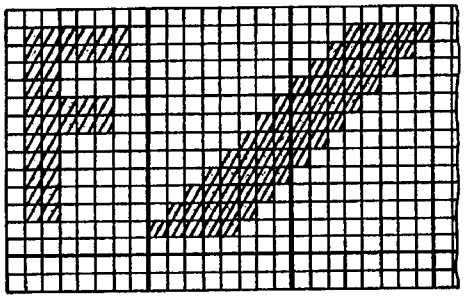
FIG. 9*b* schematically shows a small substantially enlarged portion of a monitor display illustrating different character sets in accordance with the present invention.

Referring to FIGS. 9*a* and 9*b*, a novel feature of the present invention is that the character set ROM 716 can be employed for selecting from four different character sets of different style or width. The character sets may include alphanumeric characters only, or a combination of alphanumeric and graphical characters. For example the characters "F" and "2" displayed on the monitor 900 of FIG. 9*a* are alphanumeric characters from different width character sets. The left most character "F" of FIG. 9*b* is readily seen to be from a different character set than that of the character "F" of FIG. 9*a*. The second character of FIG. 9*b* shown in the shape of a diagonal slash representative of a spare is an example of a graphical character which happens also to be part of a double width character set.

Inputs A12 and A13 of the character set ROM 716 of FIG. 8*a* are the two highest significant address bits received from processing circuitry (not shown) for selecting from one of the possible four different character sets previously stored therein. Each of the character sets (if all single width) may contain as many as 256 characters.

The novelty of having different character sets allows for a variety of character fonts to be employed mimicking the character-shape versatility of a more sophisticated bit-mapped graphics system employing a more powerful and expensive microprocessor.

Address inputs A11 through A4 of the character set ROM 716 comprise the offset address of one of the 256 possible characters per character set. Address inputs A3 through A0 are the least significant bits of the character set ROM address, enabling ROM 716 to store each 8 bit character shape string of foreground/background digital information in 14 successive addresses pertaining to each scanned line of the 8×14 character matrix.

The first column of FIG. 10 illustrates from left to right the digital values of the lowest significant bit address lines A3 through A0 of the character set ROM 716 for accessing one of 14 different scanned lines of character shape digital information. The location of each character is assigned an "offset" address at lines A11 through A4 of character set ROM 716. The second column contains 14 lines of character shape digital information stored in character set ROM 716 for the single width alphanumeric character "F" (see FIG. 9*a*) stored at a predetermined offset address. The second and third column are character shape information for a unique double width character "2" (see FIG. 9*a*) which must be stored in two successive offset addresses in the character set ROM 716 memory. Notice that the digital value ("0" or "1") of the character shape bits in columns 2 through 4 of FIG. 10 form a pattern with one another defining the shape of the single width character "F" and the double width character "2" illustrated in FIG. 9*a*.

A conventional video controller 702 automatically increments respective address inputs A3 through A0 of the character set ROM 716 one-by-one respectively through electrically coupled output lines RA3 through RA0 of the controller 702 during each successive scanned line of character to be displayed on a screen. Of course the 702 controller must sequentially access a single line of foreground/background digital information for up to 96 characters scanned and displayed from left to right on a monitor before proceeding to access the second line of information for the same sequence of characters.

As previously mentioned, a feature of the present invention is the ability to display a variety of formats and sizes of characters mimicking the versatility of bit-mapped graphics employing more powerful microprocessors. One way the present invention realizes character format versatility is by generating special multiple matrix (double width) characters. Novel "half character" character sets are employed. Using this idea, a novel double width character, such as the second character "2" (see FIGS. 9*a* and 10) can be formed from two "half characters" of a double width character set stored in the character set ROM 716 that when displayed together form a single character. The second column of FIG. 10 illustrates the character shape bits of digital information at a predetermined offset address defining a "left-half character" of the double width character "2" displayed on monitor 800 of FIG. 9. Similarly, the third column of FIG. 10 illustrates the character shape bits at the next highest offset address defining a "right-half character" of the double width character "2". Up to four sets of 128 double width characters can be stored in the character set ROM 716 since each double width character takes up twice as much memory space (two offset addresses each comprising 14 line addresses) as that of a single width character. Of course, the video controller 702 must keep track of whether a character to be displayed is single or double width. A standard XILINX circuit (see FIG. 1) sends character width information to the controller 702 as part of data inputs D7 through D0. If the character to be generated is double width, the video controller 702 sends a double width cursor to the monitor via the cursor output 10 of the video controller 702 so that the matching half width characters are always displayed on a monitor adjacent each other.

Multiple height characters may of course also be generated within the scope of the invention by employing adjacent matrices having a vertical relationship with each other. Even employing characters simultaneously having both multiple height and multiple width may be realized by employing four (4) or more adjacent matrices having horizontal and vertical relationships with each other.

The operation of the video generating circuit 700 of FIG. 8 for generating a character, such as "F" will be understood as follows. The alphanumeric character "F" with corresponding foreground and background color attributes to be later displayed on a color monitor are received via a data bus at inputs I7 through I0 of the character buffer 704 and inputs I7 through I0 of the attribute buffer 706.

Characters processed in most computers are represented in ASCII code (American Standard Code for Information Interchange) comprising base 16 (hexadecimal) numbers. The ASCII code for the alphanumeric character "F" to be displayed comprises the two digit hexadecimal number: "46" realized at the machine language level as two four-bit digital binary numbers: "01000111", where the binary "0100"=hexadecimal "4" and binary "0111"=hexadecimal "6". The eight bits of ASCII information for the character "F" are received from the data bus at data inputs I7 through I0 of the character buffer 704. The attribute buffer 706 receives from the data bus a three-bit binary number at data inputs I2 through I0 encoding one of eight different foreground colors assigned by the CPU to the character "F", and the buffer 706 receives another three-bit binary number at inputs I5 through I3 encoding one of eight different background colors assigned to the same character. The remaining two bits of digital information received at inputs I6 and I7 are address offsets for the character set ROM 716 for selecting from an external control source (not shown) one of four different character fonts that may be stored therein. The four character sets allow for greater variety of character fonts mimicking the character shape versatility found in a more expensive and sophisticated bit-mapped graphics system.

In FIG. 8*a*, an address bus communicating with external processing circuitry (not shown) or a standard 6845 video controller determines which address in a 2K (2048 byte or word capacity) character video RAM 708 and 2K attribute video RAM 710 the respective character, attribute, and character set data in buffers 704 and 706 are to be stored.

For instance, the character "F" illustrated in FIG. 9*a* (whose ASCII representation in machine language is "01000111") is chosen to be written into the initial address in memory mapped to the upper left most part of a display screen. The ASCII bits are received at the eight data inputs D7 through D0 of the character video RAM 708 and written into memory at the eleven bit memory address "00000000000" received at inputs A10 through A0 of the character video RAM 708.

The address inputs A10 through A0 of the attribute video RAM 710 simultaneously receive the same address as respective inputs A10 through A0 of the character video RAM 708 for storing the background color, foreground color, and character set select information for the character "F". Inputs D5 through D3 of attribute video RAM 710 receive three bits of digital information encoding one of eight different foreground colors assigned to the character "F" by a standard external control circuit (not shown), and inputs D2 through D0 receive another 3 bits of digital information encoding one of eight different possible background colors assigned to the character "F". Inputs D7 and D6 receive 2 bits of digital information encoding one of four different character sets stored in the character set ROM 716.

Referring again to the color encoding information of the first and second columns of FIG. 3, if the character "F", for instance, is assigned a foreground color of black, then foreground color inputs D2 through D0 of the attribute video RAM 710 will respectively receive video color digital signals having levels: BGR="000". If the character "F" is assigned a background color of yellow, then background color inputs D5 through D3 of the attribute video RAM 710 will respectively receive video color digital signals having levels: BGR="011". Finally, if the character "F" is to be selected from the last of four character sets stored in the character set ROM 716, then the character select inputs D7 through D6 of the attribute video RAM 710 will receive two logical bits of digital information. In this example, the first character set is arbitrarily defined as the two bit digital value of "00" at inputs D6 and D7, the second set is defined as the digital value "01", the third character set is defined as the digital value "10", and the fourth character set is defined as the digital value "11". Hence, both the inputs D6 and D7 of the attribute video RAM 710 will be set high to correspond to the fourth character set.

In summary, the input pins D7 through D0 of the attribute video RAM 710 will receive respective attribute bits "11000011" for the character "F" selected from the fourth character set in the character set ROM 716 with a foreground color of black and a background color of yellow.

In the video generating circuit 700 of FIG. 8*a*, the ASCII code of a particular character to be generated on a display screen is arbitrarily selected to serve as the 8-bit offset address inputs A11 through A4 of the character set ROM 716. This means that the ASCII code for a character is also the offset address in memory for the character set ROM 716 in which the character is stored. (Of course, special double width character sets and graphical characters are not standard and, therefore, must be assigned a predetermined identification code.) As may be recalled, the video controller 702 simultaneously addresses the lowest significant input address lines A3 through A0 of character set ROM 716 from respective controller output pins RA3 through RA0 in order to access 8 bits of character shape digital information for each of the 14 lines of the 8×14 character matrix.

Referring to FIG. 8*a*, as the ASCII coded bits "01000111" representing the character "F" are received at address inputs A11 through A4 of the character set ROM 716, the video controller 702 will successively access from ROM 716, the 14 lines foreground/background character shape digital information. As can be seen from shape of the character "F" illustrated in FIG. 9*a*, since the first line of 8 pixels representing the character "F" are all illuminated with the background color, the 8 bit string to illuminate the background color will be "00000000" as seen in the first line, second column of FIG. 10.

In order to access individually each bit of foreground/background pixel information, the 8 bit string of character shape bits per line of character is output in parallel at the eight output pins D7 through D0 of the character set ROM 716 and received in parallel at respective input pins A through H of an 8-bit parallel in/serial out shift register 718. During eight successive clock pulses starting with the digital information received at input A of shift register 718, background/foreground character shape bits received at inputs A through H are serially generated at SER OUT of shift register 718 and received at an input SELECT of a 2 to 1 MULTIPLEXER (MUX) 714 for sequentially selecting either the foreground color of a character (SER OUT="1") or background color of a character (SER OUT="0") to be illuminated one pixel at a time on a remote display screen.

The foreground and background color bits for the accessed character coming from data pins D5 through D0 of character attribute RAM 710 are sent to the MUX 714 via data buffer 712. The foreground color bits are received at inputs 3A through 1A of MUX 714 and the background color bits are received at inputs 3B through 1B. If the MUX SELECT input receives a bit="1" from SER OUT of the shift register 718, the foreground color bits from input pins 3A through 1A will be coupled to respective B,G,Y outputs at pins 3Y through 1Y of the MUX 714 so as to illuminate a single character pixel with the appropriate foreground color. If the MUX SELECT input receives a bit="0" from SER OUT of the shift register 718, the background color bits from input pins 3B through 1B will be coupled to respective B,G,Y outputs at pins 3Y through 1Y of the MUX 714 so as to illuminate a single character pixel with the appropriate background color.

Hence, each character shape bit stored in character set ROM 716 is extracted by means of the shift register 718. The character shape bit then selects either the foreground color or the background color stored in character attribute RAM 710 by means of the 2 TO 1 MUX 714.

If the video generating circuit 700 is part of a remote video channel as explained in FIG. 1, then the digital color signals B,G, and R output from MUX 714 are electrically coupled to the appropriate inputs of the RGB encoding circuit of FIG. 2*a* so as to be adapted for transmission along a single coaxial cable.

If the video generating circuit 700 resides in a local video channel as explained in FIG. 1, then the transmission of the color signals B,G, and R are localized within a floor-based console containing both the video generating circuit 700 and a local monitor for displaying the color information. Hence, coaxial cables as for long distance transmission with corresponding encoding and decoding circuitry are not necessary.

Figure 8B:
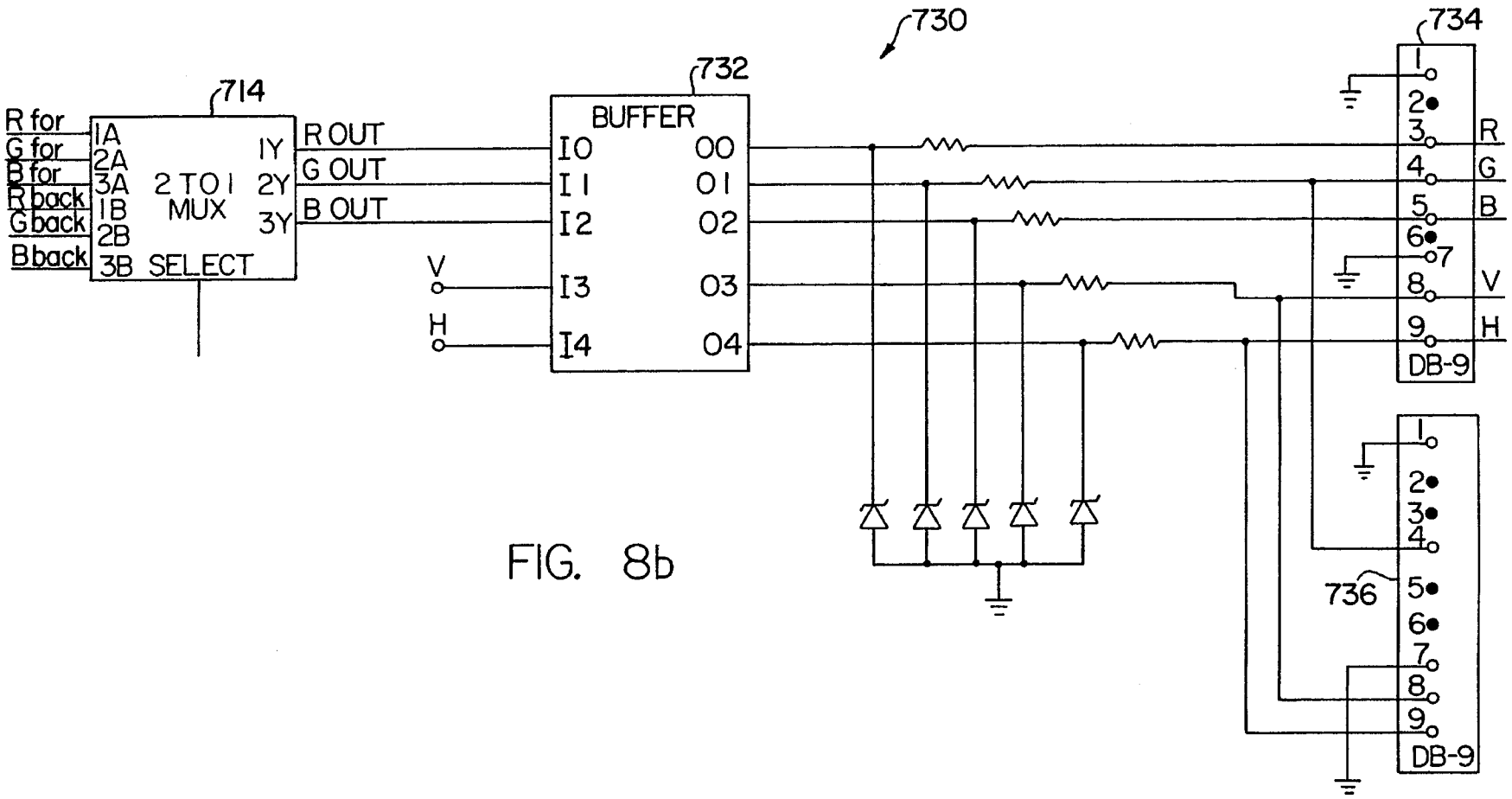
FIG. 8*b* is a schematic showing the output of the video generating circuit of FIG. 8*a* communicating with a local monitor.

FIG. 8*b* schematically illustrates a local video channel interface circuit 730 for transmitting generated R,G, and B color signals to a local monitor. MUX 714 of FIG. 8*a* is repeated in FIG. 8*b* for reference purposes.

The digital color signals R,G, and B selected by MUX 714 of FIG. 8*b* are respectively input into buffer 732 at inputs I0, I1, and I2. Vertical and horizontal synchronization digital signals are respectively input into buffer 732 at inputs I3 and I4.

The RGB digital color signals leave buffer 732 at corresponding outputs O0 through O2, and the vertical and horizontal synchronization digital signals leave the buffer 732 at corresponding outputs O3 and O4.

The outputs O0 through O4 of the buffer 732 are each connected to one end of a 47 ohm resistor. The other end of each 47 ohm resistor is respectively coupled to an appropriate pin of a standard DB9 connector communicating with a standard video cable. The video cable comprises several individually insulated conductors for the separate digital transmission of the color and synchronization digital signals to a local monitor within the local console. Each of the outputs O0 through O4 of buffer 732 is also connected to ground via a IN4733 zener diode which prevents build-up of static charge at the buffer outputs.

As is standard, the red, green, blue, vertical synchronization, and horizontal synchronization digital signals are respectively coupled to pins 3,4,5,8, and 9 of DB9 connector 734. Pins 1 and 7 are grounded, and pins 2 and 6 are not used.

DB9 connector 736 transmits "black and white" information along a separate video cable. As is standard for black and white signal transmission, only the green color signal and synchronization signals are necessary. Hence the green, vertical, and horizontal synchronization digital signals are respectively coupled to pins 4,8, and 9 of DB9 connector 736.

Another feature of the present invention involves widening a character to be displayed by reducing the rate of transmission (dot frequency) from the scanned video memory of a scanned line of color analog signals to a monitor. With the scan rate within the monitor remaining unchanged, the monitor receives less digital information than when the character transmission rate is higher. The effect of a longer transmission is to stretch each pixel and, therefore, each character appears to be wider on a monitor.

As will be explained in more detail hereinbelow, one preferred aspect of the present invention employs means for halving the dot frequency from the standard transmission rate of 16 MHz to the reduced rate of 8 MHz. The effect of the reduced dot frequency is to double the displayed width of an alphanumeric or graphical character.

FIG. 9*c* is a small substantially enlarged upper left portion of a monitor display. The left most or first displayed character "F" is the same as that of FIG. 9*a*. As will be recalled the first character "F" as seen in FIG. 9*c* is a single width character transmitted at a conventional dot frequency of 16 MHz. Typically, only 96 single width characters transmitted at a conventional dot frequency of 16 MHz can be simultaneously displayed from left to right along a typical monitor display.

The second character "F" as seen in FIG. 9*c* is the same as the first single width character "F" except for the fact that the second character is transmitted at a reduced dot frequency of 8 MHz. The effect of the reduced transmission rate is to stretch or double the width of the "single width" character as displayed on a monitor. Hence, reducing or halving the dot frequency of a transmitted single width character produces a similar effect as that of employing double width character sets. Obviously, if only 96 single width characters transmitted at a conventional dot frequency of 16 MHz can be simultaneously displayed from left to right along a display screen, only 48 single width characters transmitted at a reduced dot frequency of 8 MHz can be simultaneously displayed from left to right along a display screen.

Referring now to FIG. 9*d*, a character "2" is displayed on a small substantially enlarged upper left portion of a monitor display. The character "2" as displayed in FIG. 9*d* is the same as the double width character "2" as seen in FIG. 9*a* except that the character "2" of FIG. 9*d* is transmitted at a reduced dot frequency of 8 MHz instead of the conventional dot frequency of 16 MHz. The effect of the reduced transmission rate is to stretch or double the width of the "double width" character as displayed on a monitor. Hence, reducing or halving the dot frequency of a transmitted double width character produces the effect of generating a character four times as wide as that of a single width character transmitted at a conventional dot frequency of 16 MHz.. Obviously, if only 48 double width characters transmitted at a conventional dot frequency of 16 MHz can be simultaneously displayed from left to right along a display screen, only 24 double width characters transmitted at a reduced dot frequency of 8 MHz can be simultaneously displayed from left to right along a typical display screen.

Figure 11A:
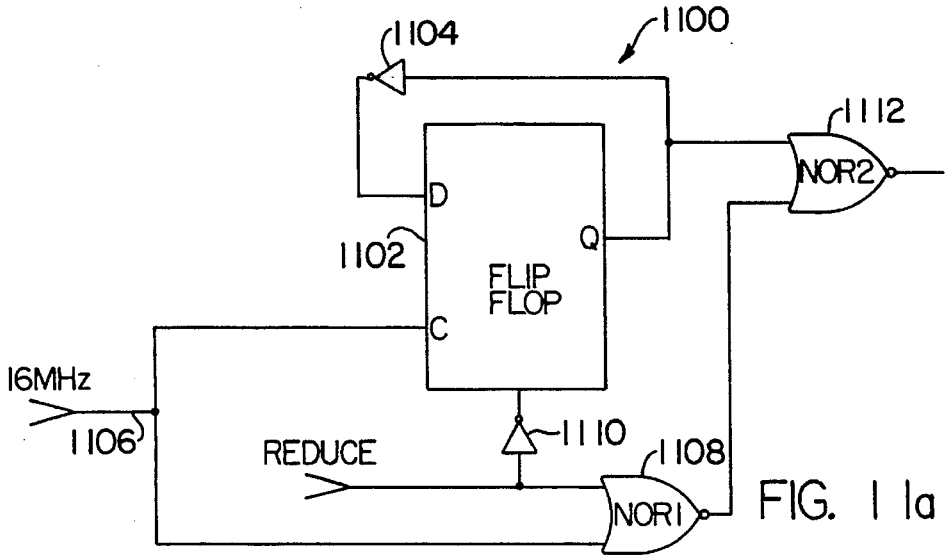
FIG. 11*a* schematically illustrates a dot frequency reducing circuit in another aspect of the present invention.
Figure 11B:
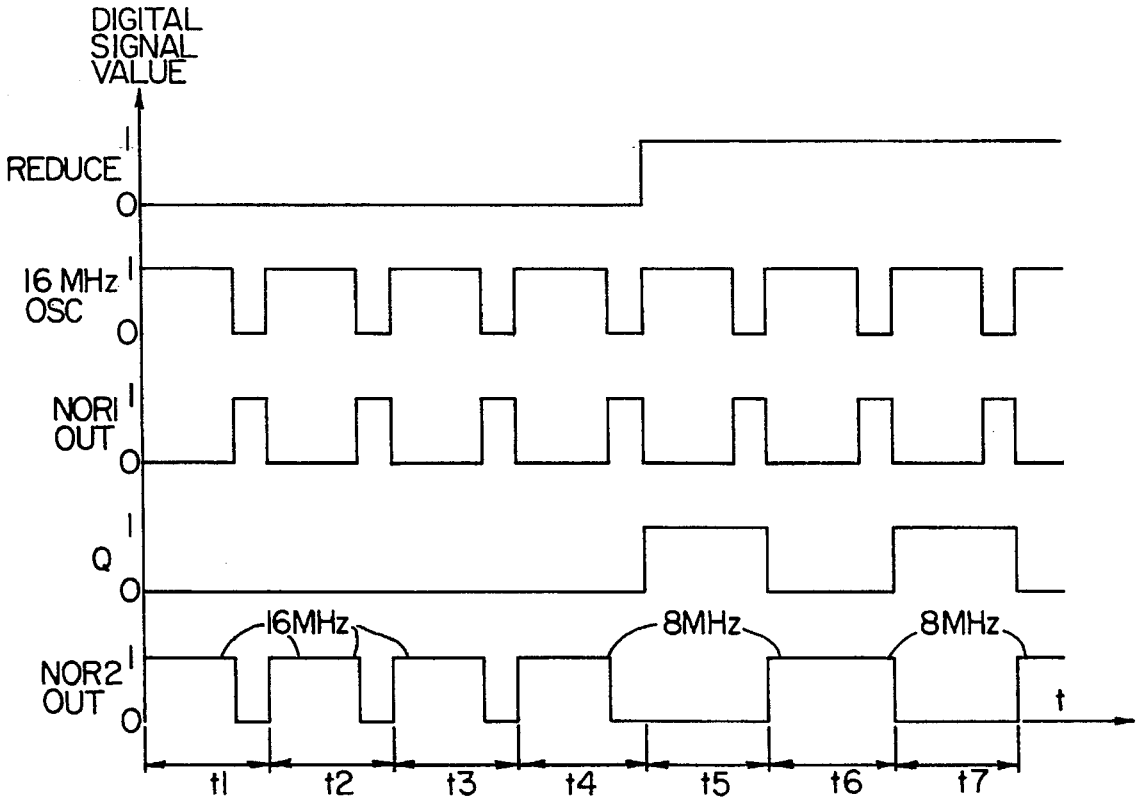
FIG. 11*b* is a timing diagram illustrating the relationship among various digital signals of the dot frequency reducing circuit of FIG. 11*a*.

Reducing the dot frequency from 16 MHz to 8 MHz can be understood with reference to FIGS. 11*a* and 11*b*. FIG. 11*a* schematically illustrates a dot frequency reducing circuit 1100 residing in conventional processing circuitry (not shown). The reducing circuit 1100 is comprised of, in this instance, a D-type flip flop 1102. A digital signal inverter 1104 is connected at its input to an output Q of the flip flop 1102, and is connected at its output to an input D of the flip flop 1102. A conventional 16 MHz clock source 1106 pulses flip flop 1102 at an input C thereof. The clock source is also one of two inputs to a digital signal NOR gate 1108 (NOR1). The other input of the NOR1 gate 1108 receives a frequency reducing digital signal REDUCE from standard processing circuit. The REDUCE control signal is also the input to a digital signal inverter gate 1110 connected at its output to the flip flop 1102 at reset input RD thereof. The function of the input RD of flip flop 1102 is to disable the flip flop from the clock source and to reset the input D thereof to a high level digital signal and to reset the output at Q thereof to a low level digital signal. The output of NOR1 gate 1108 is one of two inputs to a second NOR2 gate 1112. The other input of the NOR2 gate 1112 is connected to the output Q of flip flop 1102. The output of the NOR2 gate 1112 generates and sends to video generating circuitry either the conventional dot frequency of 16 MHz if the control digital signal REDUCE is low or the novel reduced dot frequency of 8 MHz if REDUCE is high.

The operation of the dot frequency reducing circuit of FIG. 11*a* can be understood with reference to the digital signal timing diagrams of FIG. 11*b*.

The abscissa of the timing diagram is defined by time (t). The bottom of the abscissa is divided evenly by time intervals t1 through t7 with each time interval being 1/16 millionths of a second or one cycle of the 16 MHz clock frequency.

The ordinate is broken into five separate low and high digital signal levels for digital signals present at five different locations of the frequency reducing circuit of FIG. 11*a*.

Referring again to FIG. 11*b*, the topmost horizontally extending signal represents the digital levels of the control signal REDUCE. The second signal from the top is the 16 MHz clock source. The middle signal is the output from the NOR1 logic gate. The second signal from the bottom is the output generated from the flip flop 1102 at Q. Finally, the lowermost signal is the dot frequency transmission signal generated from the NOR2 gate.

During the first four clock cycles (t1 through t4), the REDUCE control digital signal is held low or off so as to disable the frequency reducing feature. One input of the NOR1 gate 1108 of FIG. 11*a* is held low by REDUCE while the other input of NOR1 receives the 16 MHz clock source signal. As a result, the clock source signal is inverted at the output of NOR1. The low REDUCE digital signal is inverted to a high digital signal through inverter gate 1110. The high digital signal is input at RD of flip flop 1102. The high digital signal at RD effectively resets the D input to the flip flop so as to force the signal generated at D to go high. Because D should always be the inverted signal of Q by means of inverter 1104, as the digital signal at D goes high the digital signal at output Q goes low. Hence, during the first four clock cycles a sustained low digital signal from the output Q of flip flop 1102 is fed into one of the two inputs of NOR2. The other input of NOR2 is fed by the inverted clock signal generated from NOR1. As a result, the inverted clock signal fed into NOR2 is in turn inverted so as to produce a dot frequency transmission signal identical to that of the conventional 16 MHz clock source. Hence, during clock source cycles t1 through t4, the 16 MHz clock source signal becomes the dot frequency transmission signal as generated at the output of NOR2.

During the fifth through seventh clock cycles (t5 through t7), the REDUCE control digital signal goes high or on so as to enable the frequency reducing feature. One input of the NOR1 gate 1108 of FIG. 11*a* is held high by REDUCE while the other input of NOR1 receives the 16 MHz clock source signal. As a result, the 16 MHz clock source signal is inverted at the output of NOR1. REDUCE is inverted through inverter 1110 so as to send a low digital signal to input RD of flip flop 1102. The low signal present at RD disables the reset feature and enables the flip flop. From standard D-type flip flop operation, during each succeeding 16 MHz clock cycle, the clock input C of flip flop 1102 is pulsed by the clock signal source so as to shift the digital signal present at input D to the output at Q thereof. Since the signal present at D was previously high, during time interval t5 the input signal present at D shifts to the output Q thereby making the output at Q go high which in turn makes the signal at input D go low by means of inverter 1104. The high signal from output Q and the inverted clock signal generated from NOR1 are fed into NOR2. The result of feeding NOR2 with the high level signal from output Q is to force the generated dot frequency transmission signal generated at the output of NOR2 to go low during time period t5. Hence, the clock signal source is disabled at the dot frequency transmission output of NOR2 during clock source period t5.

During clock source period t6, the clock input C of flip flop 1102 is pulsed by the clock signal source so as to shift the digital signal present at input D to the output at Q thereof. Since the signal present at D was previously low during clock source period t5, during time interval t6 the input signal present at D shifts to the output Q thereby making the output at Q go low which in turn makes the signal at input D go high by means of inverter 1104. The low signal from output Q and the inverted clock signal generated from NOR1 are fed into NOR2. As a result, the inverted clock signal fed into NOR2 is in turn inverted so as to produce a dot frequency transmission signal identical to that of the conventional 16 MHz clock source. Hence, during the clock source cycle t6, the 16 MHz clock source signal again becomes the dot frequency transmission signal as generated at the output of NOR2.

During succeeding time periods, the behavior of the frequency reducing circuit 1100 will repeat that of time periods t5 and t6 as long as REDUCE is held high.

One can readily see that when REDUCE is held high the generated dot frequency is reduced to 8 MHz for the reason that the 16 MHz clock source signal is allowed to pass through NOR2 only every other clock source cycle (t4 and t6).

Figure 12:
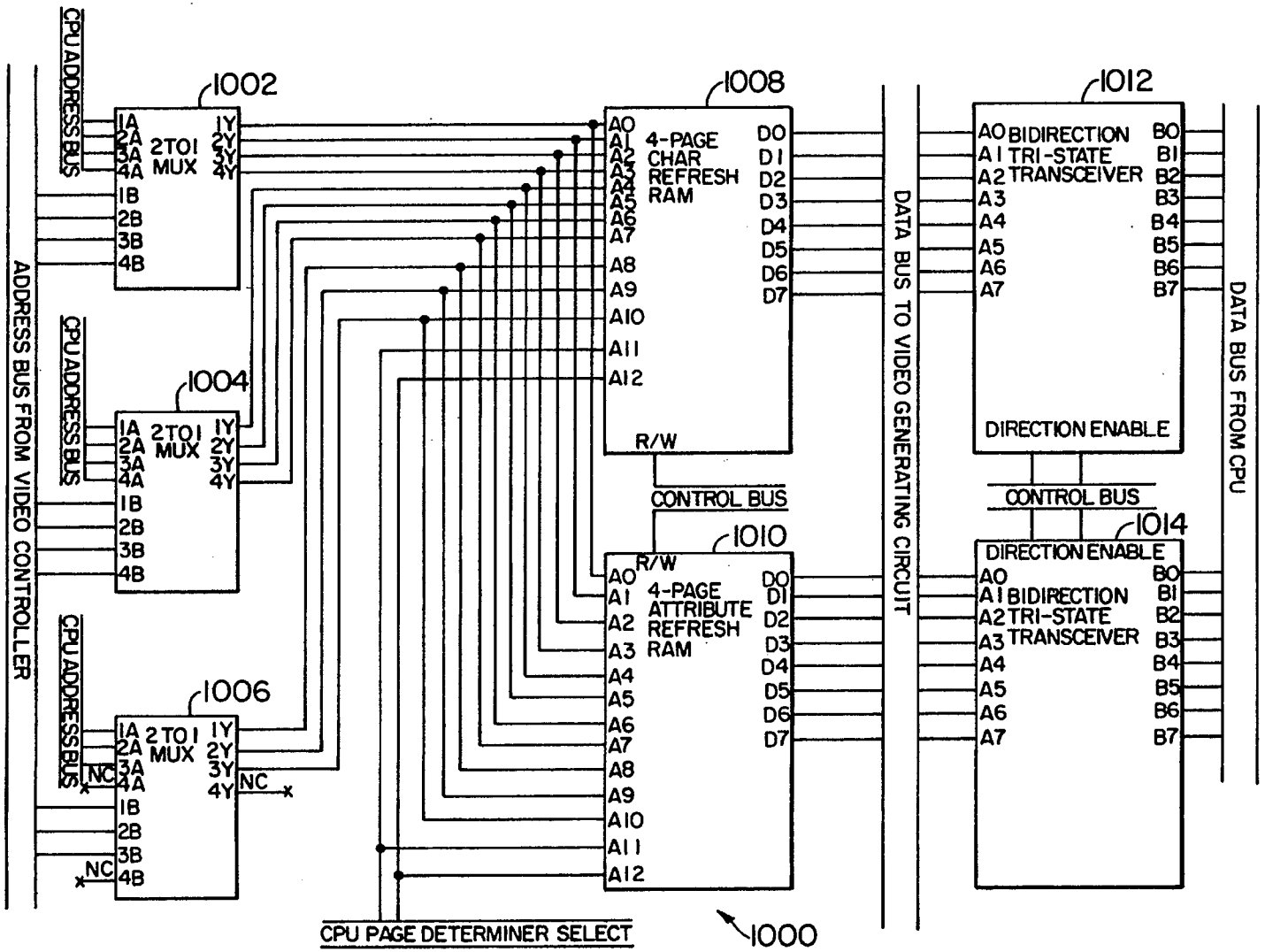
FIG. 12 is a schematic of the refresh RAM hardware used for quick page switching in another aspect of the present invention.

FIG. 12 schematically illustrates a page refresh circuit 1000 located on either a local or a remote video channel. The page refresh circuit 1000 is employed for storing four "pages" of bowling information to be later displayed on a display screen. The refresh RAMs are employed in a novel manner for preparing four additional pages of digital information without disturbing the current scanned display and without being concerned when the entries to the page refresh circuit are made. The novelty of the refresh circuitry 1000 is that all modifications to subsequent screens can be done on a non-displayed screen simultaneously with the displaying of the current screen of information stored in the current page video RAMs 708 and 710 of FIG. 8*a*. Interconnected data and address lines with those of FIG. 8*a* have identical labeling. Only after all modifications to the refresh RAMs are complete will the new pages of information be accessed by the video controller 702 of FIG. 8*a* for display.

Storing up to four pages of information in memory allows for fast page switching to the display screen so as to mimic animation capability inherent in a more expensive and sophisticated bit-mapped graphics system using complex software.

The Quad 2 TO 1 MUXs 1002,1004, and 1006 latch and select the origin of the address of character and attribute data to be stored in or retrieved from character refresh RAM 1008 and attribute refresh RAM 1010 respectively. Each of the multiplexers 1002,1004, and 1006 has an input SELECT which is activated from the processor (not shown). If SELECT is at a digital level of "1", the multiplexers 1002,1004,1006 will select an 11 bit address originating from the CPU on inputs 1A–4A of MUX 1002, 1A–4A of MUX 1004, and 1A–3A of MUX 1006 for storing character and attribute data in respective refresh RAMs 1008 and 1010. If SELECT is at a digital level of "0", the MUXs 1002,1004, and 1006 will select an 11 bit address coming from the 6845 video controller 702 of FIG. 8*a* on inputs 1B–4B of MUX 1002, 1B–4B of MUX 1004, and 1B–3B of MUX 1006 for retrieving character and attribute data for downloading to the character video RAM 708 and the attribute video RAM 710 of FIG. 8*a*. Inputs 4A and 4B of MUX 1006 are presently unused.

The address bits channeled through outputs 4Y through 1Y of MUX 1002 determine the address inputs A3 through A0 of character and attribute refresh RAMs 1008 and 1010, the address bits channeled through outputs 4Y through 1Y of MUX 1004 determine the address inputs A7 through A4, and the address bits channeled through outputs 3Y through 1Y of MUX 1006 determine the address inputs A10 through A8. Address inputs A11 and A12 received from processor circuitry (not shown) are the highest significant address bits for the refresh RAMs and are used as an offset to determine one of four possible page locations in memory in which to store or retrieve a character and its attributes.

The 8-bit character information in ASCII code is received at the character refresh RAM 1008 from a CPU data bus via a bidirectional transceiver 1012. The eight character data bits are channeled through the transceiver 1012 from I/O side pins B7 through B0 to respective I/O side pins A7 through A0. The data bits are then coupled from the respective I/O pins A7 through A0 to inputs D7 through D0 of the character refresh RAM 1008.

The 8-bits of digital attribute information for a character is received at the attribute refresh RAM 1010 from a CPU data bus via a bidirectional transceiver 1014. The eight attribute data bits are channeled through the transceiver 1014 from I/O side pins B7 through B0 to respective I/O side pins A7 through A0. The data bits are then coupled from the respective I/O pins A7 through A0 to inputs D7 through D0 of the attribute refresh RAM 1010.

Three bits of digital information encoding the foreground color of a character is received at data inputs D2 through D0 of the attribute refresh RAM 1010, three bits of information encoding the background color is received at data inputs D5 through D3, and two bits of information selecting one of four character sets is received at data inputs D7 through D6.

The video controller 702 of FIG. 8*a* receives authorization signals from standard auxiliary processing circuitry such as a XILINX circuit (not shown) at read/write pin 22 in order to scan the refresh RAM addresses and download the contents of the character and attribute refresh RAMs 1008 and 1010 into character video RAM 708 and attribute video RAM 710 respectively. A data bus tapping into the data lines of the refresh RAMs 1008 and 1010 transport data to refresh the video RAMs 708 and 710 of FIG. 8*a*.

The advantage of employing character refresh RAM 1008 and attribute refresh RAM 1010 to store up to four additional pages of character information is that a page of information stored in the refresh RAMs 1008 and 1010 can be downloaded to the video RAMs 708 and 710 in the time it takes to scan a page of information on a screen. Hence, each of the four pages of information can be sequentially and quickly accessed and downloaded into the video RAMs for immediate display on a monitor. When using special graphical characters, the quick page switching of information in the refresh RAMs to a display monitor can be used for a degree of animation thus mimicking the more sophisticated graphical capability of bit-mapped graphics.

While the present invention has been described in several preferred embodiments, it will be understood that numerous modifications and substitutions can be made without departing from the spirit and scope of the invention. For example, multiple height, or multiple height and width characters may be employed with or as a substitute for multiple width characters. Similarly, several dot frequencies with various relations to one another may be employed. Also, other appropriate means for encoding digital signals into analog voltage encoded signals may be substituted. In addition, the invention need not be limited to only eight different colors. Additional analog voltage encoding of the intensity of each primary color signal (red, green, and blue) may be incorporated for a greater variety of colors to be illuminated as a single pixel on a monitor. For example, half intensity digital color signals may be also voltage encoded with full intensity digital color signals for transmission as a single voltage encoded analog signal. Accordingly, the present invention has been described in several preferred embodiments by way of illustration, rather than limitation.

We claim:

1. In an automated bowling scoring display system including at least one remote monitor and having means for generating red digital signals for transmission along a first coaxial cable to the remote monitor, means for generating green digital signals for transmission along a second coaxial cable to the remote monitor, and means for generating blue digital signals for transmission along a third coaxial cable to the remote monitor, wherein the improvement comprises:

means for voltage level encoding into a single color analog signal a three digit binary number with each digit of said number corresponding to a respective digital value of said red, green, and blue digital signals so as to permit transmission of said single color analog signal along a single coaxial cable to said remote monitor;

means for generating a horizontal synchronization analog signal which voltage level encodes a horizontal synchronization digital signal for transmission along said single coaxial cable to said remote monitor after sequentially sending a plurality of said single color analog signals; and means for generating a vertical synchronization analog signal which voltage level encodes a vertical synchronization digital signal for transmission along said single coaxial cable to said remote monitor at a time different from that of transmitting said plurality of said single color analog signals and said horizontal synchronization analog signal.

2. An automated bowling scoring display system according to claim 1 further including means for generating a plurality of monitor configuration analog signals for sequential transmission along said single coaxial cable.

3. An automated bowling scoring display system according to claim 1 further including means for communicating with a signal exit end of said single coaxial cable for decoding said single color analog signal back into said red, green, and blue digital signals.

4. An automated bowling scoring display system according to claim 1 further including means for communicating with a signal exit end of said single coaxial cable for decoding said horizontal synchronization analog signal back into said horizontal synchronization digital signal, and for decoding said vertical synchronization analog signal back into said vertical synchronization digital signal.

5. An automated bowling scoring display system according to claim 2 further including receiving means for communicating with an analog signal exit end of said single coaxial cable for separating said plurality of monitor configuration analog signals.

6. An automated bowling scoring display system according to claim 1 further including character set memory for storing foreground and background character-shape digital information of single and multiple matrix characters to be displayed on said monitor, the single matrix characters being defined by a single matrix of digital information of a predetermined size, the multiple matrix characters being comprised of a plurality of matrices of digital information, each matrix of said multiple matrices of digital information defining a part of a character that when displayed together on said monitor form a single character.

7. An automated bowling scoring display system according to claim 1, further including character set memory for storing foreground and background character-shape digital information of single and double width characters to be displayed on said monitor, the single width characters being defined by a single matrix of digital information of a predetermined size, the double width characters being comprised of two matrices of digital information, each matrix of said two matrices of digital information defining a part of a character that when displayed together on said monitor form a single character.

8. An automated bowling scoring display system according to claim 6 wherein said character set memory stores a plurality of character sets, each one of said character sets having characters represented in a distinct font relative to the other fonts.

9. An automated bowling scoring display system according to claim 1 further including scanned character video memory and scanned attribute video memory for respectively storing a page of character and attribute digital information for immediate display on a monitor by means of a video controller; and refresh character video memory and refresh attribute video memory for respectively storing a plurality of additional pages of character and attribute digital information, each of said plurality of additional pages of character and attribute digital information to be later downloaded in rapid succession to said scanned video memory and displayed on said monitor so as to mimic animation of a more sophisticated bit-mapped graphics system, said refresh character and attribute video memory to be updated while digital information stored in said character and attribute scanned video memory is displayed.

10. An automated bowling scoring display system according to claim 1 further including means for generating a plurality of monitor configuration analog signals for sequential transmission along said single coaxial cable.

11. An automated bowling scoring display system according to claim 1 further including:

means for communicating with a signal exit end of said single coaxial cable for decoding said single color analog signal back into said red, green, and blue digital signals; and means for communicating with a signal exit end of said single coaxial cable for decoding said horizontal synchronization analog signal back into said horizontal synchronization digital signal, and for decoding said vertical synchronization analog signal back into said vertical synchronization digital signal.

12. An automated bowling scoring display system according to claim 10 further including receiving means for communicating with a signal exit end of said single coaxial cable for separating said plurality of monitor configuration analog signals.

13. An automated bowling scoring display system according to claim 1 further including character set memory for storing foreground and background character-shape digital information of single and multiple matrix characters to be displayed on said monitor, the single matrix characters being defined by a single matrix of digital information of a predetermined size, the multiple matrix characters being comprised of a plurality of matrices of digital information, each matrix of said multiple matrices of digital information defining a part of a character that when displayed together on said monitor form a single character.

14. An automated bowling scoring display system according to claim 1 further including character set memory for storing foreground and background character-shape digital information of single and double width characters to be displayed on said monitor, the single width characters being defined by a single matrix of digital information of a predetermined size, the double width characters being comprised of two matrices of digital information, each matrix of said two matrices of digital information defining a part of a character that when displayed together on said monitor form a single character.

15. An automated bowling scoring display system according to claim 13 wherein the character set memory stores a plurality of character sets, each of said character sets representing said characters in a distinct font relative to the other character sets.

16. An automated bowling scoring display system according to claim 1 further including scanned character video memory and scanned attribute video memory for respectively storing a page of character and attribute digital information for immediate display on said monitor by means of a video controller; and refresh character video memory and refresh attribute video memory for respectively storing a plurality of additional pages of characters and attribute digital information, each of said plurality of additional pages of character and attribute digital information to be later downloaded in rapid succession to said scanned video memory and displayed on said monitor so as to mimic animation of a more sophisticated bit-mapped graphics system, said refresh character and attribute video memory to be updated while digital information stored in said character and attribute scanned video memory is displayed.

17. An automated bowling scoring display system according to claim 6 further including a frequency reducing circuit for slowing a standard transmission rate of said color analog signals so as to widen the characters displayed on said monitor.

18. An automated bowling scoring display system according to claim 17 wherein said frequency reducing slows said standard transmission rate of said color analog signals by a factor of two.

19. An automated bowling scoring display system according to claim 17 wherein said frequency reducing circuit slows said standard transmission rate of said color analog signals from approximately 16 million cycles per second to approximately 8 million cycles per second.

20. In an automated bowling scoring display system including at least one remote monitor and having means for generating at least two synchronization digital signals suitable for transmission along a coaxial cable to the remote monitor, wherein the improvement comprises:

means for voltage level encoding at least two synchronization analog signals each corresponding to one of said synchronization digital signals for transmission along said single coaxial cable, said synchronization analog signals including a first and second analog signal, the first synchronization analog signal being on a small percentage of a first duty cycle and off a large percentage of a first duty cycle, the second synchronization analog signal having a second duty cycle of longer duration than that of the first duty cycle, and the second synchronization analog signal being on for a longer duration relative to that of the first synchronization analog signal.

21. An automated bowling scoring display system according to claim 20 wherein control logic determines the waveform of said second synchronization analog signal by means of inverting one or more of said first duty cycles of said first synchronization analog signal.

22. An automated bowling scoring display system according to claim 20 wherein said synchronization digital signals comprise a horizontal synchronization digital signal and a vertical synchronization digital signal, and said synchronization analog signals comprise a horizontal synchronization analog signal and a vertical synchronization analog signal.

23. An automated bowling scoring display system according to claim 22 wherein said horizontal synchronization analog signal is on a small percentage of a first duty cycle and off a large percentage of said first duty cycle, said vertical synchronization analog signal has a second duty cycle of longer duration than that of said first duty cycle, and said vertical synchronization analog signal is on for a longer duration relative to that of said horizontal synchronization analog signal.

24. An automated bowling scoring display system according to claim 22 wherein control logic determines the waveform of said vertical synchronization analog signal by means of inverting one or more of said first duty cycles of said horizontal synchronization analog signal.

25. An automated bowling scoring display system according to claim 10 further including:

means for communicating with a signal exit end of said single coaxial cable for decoding said single color analog signal back into said red, green, and blue digital signals;

means for communicating with a signal exit end of said single coaxial cable for decoding said horizontal synchronization analog signal back into said horizontal synchronization digital signal, and for decoding said vertical synchronization analog signal back into said vertical synchronization digital signal; and receiving means for communicating with a signal exit end of said single coaxial cable for separating said plurality of monitor configuration analog signals.

26. In an automated bowling scoring display system including at least one remote monitor and having means for generating red digital signals for transmission to the remote monitor, means for generating green digital signals for transmission to the remote monitor, means for generating blue digital signals for transmission to the remote monitor, means for generating horizontal synchronization digital signals for transmission to the remote monitor, means for generating vertical synchronization digital signals for transmission to the remote monitor wherein the improvement comprises:

a multiplexer comprising at least eight inputs and one output for voltage level encoding said red, green, and blue digital signals into a color analog signal representing one of eight different colors to be illumined as a pixel at the remote monitor; said inputs being electrically connected to a different voltage level; and said red, green, and blue digital signals acting as control signals for the multiplexer for selecting one of said different voltage levels present at said inputs to be electrically connected to said output for transmission along said single coaxial cable to said remote monitor.

27. An automated bowling scoring display system according to claim 26 wherein said multiplexer includes eight input terminals.

28. An automated bowling scoring display system according to claim 26 wherein said blue digital signal is the most significant digit of said three digit binary number, said green digital signal is the next highest significant digit, and said red digital signal is the least significant digit.

29. An automated bowling scoring display system according to claim 26 wherein the inputs of the multiplexer are electrically connected to said different voltage levels by means of a voltage divider circuit.

30. An automated bowling scoring display system according to claim 29 wherein said voltage divider circuit is calibrated to generate voltage levels with approximately equal voltage level differences between any two most closely spaced voltage levels.

31. An automated bowling scoring display system according to claim 30 wherein the analog color signal representing the color black is the lowest voltage level encoded analog signal, and the analog color signal representing the color white is the highest voltage level encoded analog signal.

32. An automated bowling scoring display system according to claim 26 further including one or more synchronization switches for generating a voltage level encoded horizontal synchronization analog signal when said horizontal digital signal is active, and for generating a voltage level encoded vertical synchronization analog signal when said vertical synchronization digital signal is active, said synchronization switches being electrically connected to respective predetermined voltage levels at one end and communicating with said single coaxial cable at another end for voltage level encoding said horizontal synchronization analog signal and for voltage level encoding said vertical synchronization analog signal, said horizontal and vertical synchronization analog signals being at different voltage levels than those of said color analog signals.

33. An automated bowling scoring display system according to claim 32 wherein said horizontal synchronization analog signal and said vertical synchronization analog signal are separately transmitted via only one of said synchronization switches.

34. An automated bowling scoring display system according to claim 32 wherein said horizontal synchronization analog signal and said vertical synchronization analog signal are voltage level encoded at the same voltage level.

35. An automated bowling scoring display system according to claim 34 wherein said horizontal synchronization analog signal and said vertical synchronization analog signal are voltage level encoded at approximately zero volts.

36. An automated bowling scoring display system according to claim 32 wherein said horizontal synchronization analog signal is on a small percentage of a first duty cycle and off a large percentage of said first duty cycle, said vertical synchronization analog signal has a second duty cycle of longer duration than that of said first duty cycle, and said vertical synchronization analog signal is on for a longer duration relative to that of said horizontal synchronization analog signal.

37. An automated bowling scoring display system according to claim 32 further including one or more monitor configuration switches for generating a plurality of monitor configuration analog signals for sequential transmission along said single coaxial cable to said remote monitor after transmitting said color analog signals.

38. An automated bowling scoring display system according to claim 37 wherein said monitor configuration signals are voltage level encoded at a different voltage level than those of said color analog signals, said horizontal synchronization analog signal, and said vertical synchronization analog signal.

39. An automated bowling scoring display system according to claim 38 wherein said monitor configuration signals are voltage level encoded at approximately six volts.

40. An automated bowling scoring display system according to claim 37 further including:

control logic for disabling said multiplexer when said horizontal synchronization analog signal, said vertical synchronization analog signal, and said monitor configuration analog signals are to be transmitted, said control logic activating said synchronization switches when a horizontal synchronization analog signal and a vertical synchronization analog signal are to be generated for separate transmission along said single coaxial cable, said control logic activating said monitor configuration switches when a monitor configuration analog signal is to be generated for transmission along said single coaxial cable.

41. An automated bowling scoring display system according to claim 40 wherein said control logic determines the waveform of said vertical synchronization analog signal by means of inverting one or more of said first duty cycles of said horizontal synchronization analog signal.

42. An automated bowling scoring display system according to claim 37 further including:

an analog signal decoding circuit comprising:

at least eight voltage comparators each having a first input communicating with an analog signal output of said single coaxial cable, and each of said voltage comparators having a second reference input connected to a different voltage level, said voltage comparators collectively generating at respective outputs a combination of digital signals representing a voltage level of said analog signal output of said single coaxial cable; and a programmable logic array (PLA) for receiving from said comparators said combination of digital signals at separate inputs thereof for decoding said combination of digital signals back into said red, green, and blue digital signals, said red, green, and blue digital signals respectively generated at red, green, and blue outputs of said PLA during a transmission of a color analog signal along said single coaxial cable.

43. An automated bowling scoring display system according to claim 42 wherein said PLA is adapted to receive said combination of digital signals for detecting a transmission of said horizontal synchronization analog signal and said vertical synchronization analog signal.

44. An automated bowling display system according to claim 43 wherein said analog signal decoding circuit further includes a frequency filter communicating digital information to an input of said PLA for distinguishing between said horizontal synchronization analog signal and said vertical synchronization analog signal transmitted along said single coaxial cable, said PLA having a horizontal synchronization output thereof for generating a horizontal synchronization digital signal during the transmission of a horizontal synchronization analog signal, and said PLA having a vertical synchronization output thereof for generating said vertical synchronization digital signal during the transmission of a vertical synchronization analog signal.

45. An automated bowling scoring display system according to claim 44 wherein said frequency filter comprises an RC digital circuit.

46. An automated bowling scoring display system according to claim 44 further including monitor configuration receiving circuit communicating with said analog signal output of said single coaxial cable, said receiving circuit comprising one or more serial-in/parallel-out shift registers for electrically separating each of said monitor configuration analog signals, and said PLA an enable output thereof for generating an enable digital signal for said monitor configuration receiving circuit.

47. An automated bowling scoring display system according to claim 46 wherein said PLA generates said enable digital signal immediately after generating said horizontal synchronization digital signal.

48. An automated bowling scoring display system according to claim 46 wherein said monitor configuration receiving circuit receives as data digital signals generated from one of said voltage comparators so calibrated as to be activated only when a monitor configuration analog signal is at one of two possible voltage levels.

49. An automated bowling scoring display system according to claim 26 further including a frequency reducing circuit for slowing a standard transmission rate of said color analog signals so as to widen the characters displayed on said monitor.

50. A character-based automated bowling scoring display system comprising:

a character set memory for storing digital information comprising a plurality of character sets containing foreground and background character-shape digital information of characters to be displayed on a monitor, each of said character sets having characters represented in a distinct font relative to the other character sets; and means for selectively displaying said characters on a monitor character-by-character so as to convey bowling score information including bowlers' names or initials.

51. An automated bowling scoring display system according to claim 50 wherein said characters are selectively displayed on said monitor by means of a video controller, each bit of digital information of said characters to be displayed being extracted by means of a parallel-in/serial-out shift register.

52. An automated bowling scoring display system according to claim 50 wherein said character set memory includes storage capacity of at least 16 kilobytes of character-shape digital information comprising at least four of said character sets.

53. An automated bowling scoring display system according to claim 50 wherein said characters include at least one of single and multiple matrix characters, said single matrix characters being defined by a single matrix of digital information of a predetermined size stored in said character set memory, said multiple matrix of digital information being comprised of a plurality of matrices of digital information stored in said character set memory, each matrix of said plurality of matrices defining part of a character that when displayed together on said monitor form a single character.

54. An automated bowling scoring display system according to claim 50 wherein said characters include at least one of single width and double width characters, said single width characters being defined by a single matrix of digital information of a predetermined size stored in said character set memory, said double width characters being comprised of two matrices of digital information stored in said character set memory with each matrix of said plurality of matrices defining a half-character that when displayed together on said monitor form a single character.

55. An automated bowling scoring display system according to claim 53 wherein said matrix of digital information is comprised of at least eight columns by at least fourteen rows of digital information.

56. An automated bowling scoring display system according to claim 50 further including a frequency reducing circuit for slowing a standard transmission rate of said color analog signals so as to widen the characters displayed on said monitor.

57. An automated bowling display system comprising:

at least 2K bytes of scanned character video memory and at least 2K bytes of scanned attribute video memory for respectively storing a page of character and attribute digital information for immediate display on a monitor by means of a video controller; and at least 8K bytes of refresh character video memory and at least 8K bytes of refresh attribute video memory for respectively storing at least four additional pages of character and attribute digital information, each of said four additional pages of character and attribute digital information to be later downloaded in rapid succession to said scanned video memory and displayed on said monitor, said refresh character and attribute video memory to be updated while digital information stored in said character and attribute scanned video memory is displayed.

58. An automated bowling scoring display system according to claim 57 wherein said attribute digital information stored in said scanned attribute video memory for each character stored in said scanned character video memory comprises:

at least three bits of digital information for encoding one of at least eight background colors to be illuminated as a pixel on a monitor; and at least three bits of digital information for encoding one of at least eight foreground colors to be illuminated as a pixel on said monitor.

59. An automated bowling scoring display system according to claim 58 further including at least two bits of digital information for encoding one of at least four character sets by which a character is to be displayed on said monitor.

60. An automated bowling scoring display system according to claim 57 further including a frequency reducing circuit for slowing a standard transmission rate of said color analog signals so as to widen the characters displayed on said monitor.

61. An automated bowling scoring display system comprising:

scanned character video memory and scanned attribute video memory for respectively storing a page of character and attribute digital information for immediate display on a monitor by means of a video controller; and refresh character video memory and refresh attribute video memory for respectively storing a plurality of additional pages of character and attribute digital information, each of said plurality of additional pages of character and attribute digital information to be later downloaded in rapid succession to said scanned video memory and displayed on said monitor, said refresh character and attribute video memory to be updated while digital information stored in said character and attribute scanned video memory is displayed.

62. An automated bowling scoring display system according to claim 61 wherein said scanned character video memory and said scanned attribute video memory each has the capacity to store at least 2 kilobytes of digital information representing a page of character and attribute digital information to be immediately displayed on said monitor.

63. An automated bowling scoring display system according to claim 61 wherein said refresh character video memory and said refresh attribute video memory each has the capacity to store at least 8 kilobytes of digital information representing at least four additional pages of character and attribute digital information to be later downloaded in rapid succession to said scanned video memory and displayed on said monitor.

64. An automated bowling scoring display system according to claim 61 further including a frequency reducing circuit for slowing a standard transmission rate of said color analog signals so as to widen the characters displayed on said monitor.

65. A character-based automated bowling scoring display system comprising:

means for voltage level encoding into a single color analog signal a three digit binary number with each digit of said number corresponding to a respective digital value of said red, green, and blue digital signals so as to permit transmission of said single color analog signal along a single coaxial cable to a remote monitor;

a character set memory for storing digital information comprising a plurality of character sets containing foreground and background character-shape digital information of characters to be displayed on a monitor, each one of said character sets having characters represented in a distinct font relative to the other character fonts;

means for selectively displaying said characters on said monitor character-by-character so as to convey bowling score information including bowlers' names or initials;

scanned character video memory and scanned attribute video memory for respectively storing a page of character and attribute digital information for immediate display on said monitor by means of a video controller;

refresh character video memory and refresh attribute video memory for respectively storing a plurality of additional pages of character and attribute digital information, each of said plurality of additional pages of character and attribute digital information to be later downloaded in rapid succession to said scanned video memory and displayed on said monitor, said refresh character and attribute video memory to be updated while digital information stored in said character and attribute scanned video memory is displayed.

66. An automated bowling scoring display system according to claim 65 wherein said characters include at least one of single and multiple matrix characters, said single matrix characters being defined by a single matrix of digital information of a predetermined size stored in said character set memory, said multiple matrix of digital information being comprised of a plurality of matrices of digital information stored in said character set memory, each matrix of said plurality of matrices defining part of a character that when displayed together on said monitor form a single character.

67. An automated bowling scoring display system according to claim 65 wherein said characters include at least one of single width and double width characters, said single width characters being defined by a single matrix of digital information of a predetermined size stored in said character set memory, said double width characters being comprised of two matrices of digital information stored in said character set memory with each matrix of said plurality of matrices defining a half-character that when displayed together on said monitor form a single character.

68. An automated bowling scoring display system according to claim 66 wherein said matrix of digital information is comprised of at least eight columns by at least fourteen rows of digital information.

69. An automated bowling display system according to claim 68 wherein said matrix of digital information is comprised of eight columns by fourteen rows.

70. An automated bowling scoring display system according to claim 65 wherein said character set memory has the capacity to store at least 16 kilobytes of character-shape digital information comprising at least four of said character sets.

71. An automated bowling display system according to claim 65 wherein at least 2K bytes of scanned character video memory and at least 2K bytes of scanned attribute video memory are provided for respectively storing a page of character and attribute digital information for immediate display on said monitor.

72. An automated bowling scoring display system according to claim 65 wherein at least 8K bytes of refresh character video memory and at least 8K bytes of refresh attribute video memory are provided for respectively storing at least four additional pages of character and attribute digital information to be later downloaded in rapid succession to said scanned video memory and displayed on said monitor.

* * * * *